US006247788B1

(12) United States Patent
Kamei

(10) Patent No.: US 6,247,788 B1
(45) Date of Patent: Jun. 19, 2001

(54) INKJET RECORDING APPARATUS AND METHOD FOR PREVENTING GENERATION OF UNEVENNESS IN DENSITY OF A RECORDED IMAGE

(75) Inventor: Toshihito Kamei, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/317,074

(22) Filed: May 17, 1999

(30) Foreign Application Priority Data

May 20, 1998 (JP) ..... 10-137835

(51) Int. Cl.[7] ..... B41J 2/145; B41J 2/15; B41J 29/38

(52) U.S. Cl. ..... 347/41; 347/14

(58) Field of Search ..... 347/41, 14, 37; 358/298

(56) References Cited

U.S. PATENT DOCUMENTS 5,889,537 * 3/1999 Shimada ..... 347/41
5,946,011 * 8/1999 Kanaya ..... 347/41

FOREIGN PATENT DOCUMENTS 3-56186 8/1991 (JP) .
5155040 6/1993 (JP) .
7242025 9/1995 (JP) .
2613205 2/1997 (JP) .
9290508 11/1997 (JP) .
10129040 5/1998 (JP) .
10278245 10/1998 (JP) .

* cited by examiner

*Primary Examiner*—Thinh Nguyen
(74) *Attorney, Agent, or Firm*—Cooper & Dunham LLP

(57) ABSTRACT

An inkjet recording apparatus and method reduces band-like unevenness in a recorded image which unevenness is generated in relation to an interlace printing method. A recording head has a plurality of nozzles arranged at a uniform interval D in a sub-scanning direction. A control unit controls a scanning operation so that k main scanning operations are performed within the interval D, where k is an integer equal to or greater than 2. A part of an area recorded by the nth main scanning operation is overlapped with a part of an area recorded by the (n+k)th main scanning operation, where n is an integer equal to or greater than 1. A part of dots included in the overlapping area is recorded by the nth main scanning operation so that the rest of the dots included in the overlapping area are complementarily recorded by the (n+k) th main scanning operation. The complementarily recording is performed in accordance with a banding pattern table having a matrix size greater than "2×3" or "3×2".

23 Claims, 24 Drawing Sheets

FIG.9
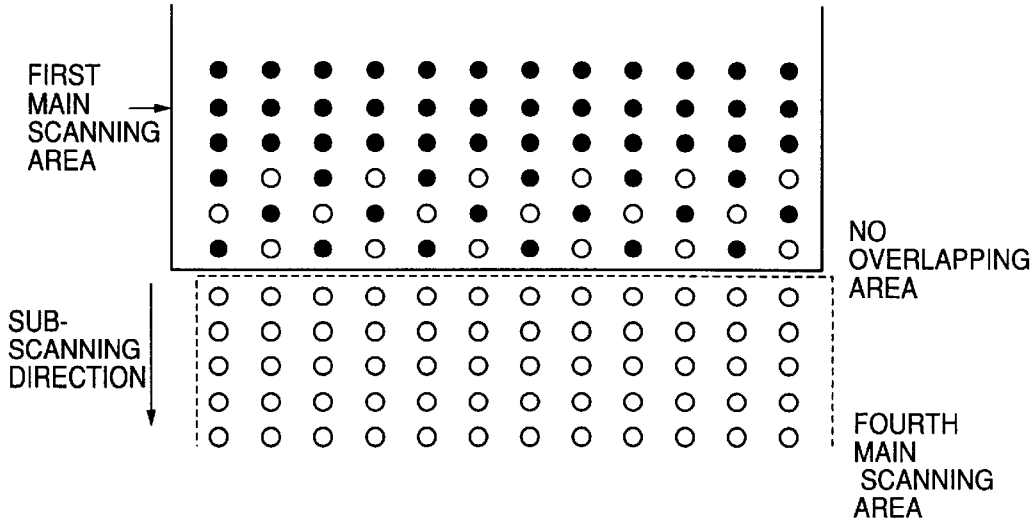
FIG.10A
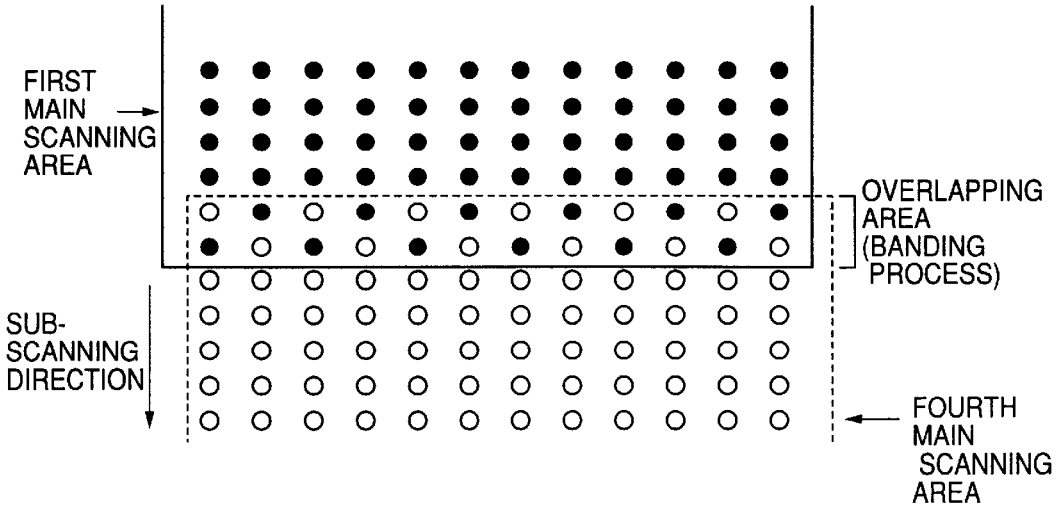
FIG.10B
| | |
|---|---|
| 0 | 1 |
| 1 | 0 |

| | | |
|---|---|---|
| 1 | 0 | 1 |
| 1 | 1 | 0 |

| | |
|---|---|
| 1 | 0 |
| 0 | 1 |
| 1 | 1 |

| | | | | | | | |
|---|---|---|---|---|---|---|---|
| 4 | 3 | 8 | 1 | 7 | 5 | 4 | D |
| 1 | 0 | 9 | 9 | D | 6 | F | B |
| D | 2 | A | A | 1 | 2 | 2 | 8 |
| D | B | 3 | A | E | 5 | 0 | 2 |
| D | 4 | 3 | 5 | B | D | 0 | F |

FIG.14

| | | | | | | | | | | | | | | | |
|---|---|---|---|---|---|---|---|---|---|---|---|---|---|---|---|
| 4 | 3 | 8 | 1 | 7 | 5 | 4 | D | D | 7 | 4 | B | 6 | 9 | 4 | B |
| E | 2 | D | 4 | 8 | 9 | 5 | 9 | 6 | 8 | B | 5 | B | 2 | 4 | E |
| 8 | 0 | C | 2 | 9 | A | 7 | 0 | 7 | 9 | 8 | F | 0 | 8 | 5 | 9 |
| 4 | 1 | F | 1 | 9 | 7 | A | 3 | B | C | 8 | 7 | D | 8 | A | 1 |
| F | 8 | 0 | D | B | 5 | 3 | 4 | D | 2 | 0 | 5 | E | 3 | B | 8 |
| 7 | B | 9 | 8 | C | 9 | 0 | A | 4 | B | F | 1 | 1 | F | D | F |
| 8 | C | E | B | 4 | 1 | 7 | 7 | 0 | 1 | 7 | F | 8 | D | 1 | A |
| 5 | 0 | 0 | A | 0 | 2 | D | E | 1 | 4 | F | 4 | 5 | 2 | B | 8 |
| 7 | 8 | D | 8 | 0 | 8 | 7 | 1 | F | 2 | 5 | 3 | 9 | B | 2 | 5 |

SINGLE-NOZZLE LINE METHOD

MULTI-NOZZLE LINE METHOD

INKJET RECORDING APPARATUS AND METHOD FOR PREVENTING GENERATION OF UNEVENNESS IN DENSITY OF A RECORDED IMAGE

BACKGROUND OF THE INVENTION

1. Field of the Invention

The present invention generally relates to an inkjet recording apparatus and method and, more particularly, to an inkjet recording apparatus and method for recording an image on a recording medium by an interlace printing method.

2. Description of the Related Art

Inkjet recording apparatuses are used in various image-forming apparatuses such as a printer, a facsimile machine or a copy machine. There are several types of inkjet recording apparatuses such as a serial scanning type inkjet recording apparatus or a line type inkjet recording apparatus.

The line type inkjet recording apparatus records an image by using a recording head having a length corresponding to the entire length of a main scanning area. That is, the recording head is provided with a plurality of nozzles arranged in an extending direction of the recording head which corresponds to a main scanning direction so that the nozzles cover the entire width of a recording medium such as a recording paper on which an image is formed. According to the line type inkjet recording apparatus, an image is recorded on the recording medium by projecting ink drops onto the recording medium by moving the recording medium in a direction perpendicular to the extending direction of the recording head.

The serial scanning type inkjet recording apparatus records an image by using a recording head having a plurality of nozzles arranged in a sub-scanning direction. An image is recorded on a recording medium such as a recording paper by projecting ink drops onto the recording medium by moving the recording head in a main scanning direction while the recording medium is stepwisely moved in a sub-scanning direction.

In the above-mentioned inkjet recording apparatuses, recording density (dot density) is determined by a pitch of the nozzles provided on the recording head. Accordingly, in order to achieve a high-density recording, the pitch of the nozzles must be decreased. However, there is a limit in the pitch size due to difficulty in formation of the nozzles with a small pitch. Thus, there is a limit in increasing the recording density.

As a conventional inkjet recording apparatus, Japanese Patent Publication No.3-56186 discloses an inkjet recording apparatus which uses an interlace printing method in which a main scanning is performed k times while a recording head moves a single pitch D of nozzles arranged on the recording head in a sub-scanning direction so as to record an image with a dot density smaller than the pitch D of the nozzles in the sub-scanning direction. Additionally, Japanese Patent No.2613205 discloses an inkjet recording apparatus which has a recording head provided with N nozzles and performs a main scanning operation and a sub-scanning operation with a dot pitch P alternately n times, and, thereafter, a sub-scanning is performed with a pitch corresponding to $P\{n(N-1)+1\}$.

Additionally, Japanese Laid-Open Patent Application No.7-242025 discloses an inkjet recording apparatus which eliminates a non-recordable area generated when an image is recorded by an interlace printing method such as that used in the inkjet recording apparatus disclosed in the above-mentioned Japanese Patent Publication No.3-56186.

Further, Japanese Laid-Open Patent Application No.5-155040 discloses an inkjet recording apparatus which generates an irregular thin-out pattern in a template buffer by utilizing a random numbers each time a recording operation corresponding to a single scanning is performed so that a lower half of data corresponding to a single scanning operation and an upper half of data corresponding to a subsequent scanning operation are thinned out in accordance with the thin-out pattern.

However, in the above-mentioned conventional inkjet recording apparatuses which use an interlace printing method in which a plurality of main-scanning operations are performed while the recording head travels a distance corresponding to a pitch of the nozzles, an unevenness in density of a recorded image is generated in an area between a part of the recorded image by a train of nozzles and a subsequent part of the recorded image since a travel of a recording head in a sub-scanning direction fluctuates due to variation in a thickness of a recording medium on which the image is recorded or an eccentricity of a roller for feeding the recording medium. The unevenness in image density is generally referred to as a band which is periodically appears in each area between series of scanning operations in a sub-scanning direction.

Additionally, in the inkjet recording apparatus using a template buffer, there is a problem in that a large memory is required since the buffer must store data corresponding to a whole scanning operation.

SUMMARY OF THE INVENTION

It is a general object of the present invention to provide an improved and useful inkjet recording apparatus and method in which the above-mentioned problems are eliminated.

A more specific object of the present invention is to provide an inkjet recording apparatus and method which reduces band-like unevenness in a recorded image which unevenness is generated in relation to an interlace printing method.

In order to achieve the above-mentioned objects, there is provided according to one aspect of the present invention an inkjet recording apparatus for recording a dot image on a recording medium by using an interlace recording method, the inkjet recording apparatus comprising:

a recording head having a plurality of nozzles arranged at a uniform interval D in a sub-scanning direction;

a moving mechanism for moving the recording medium in the sub-scanning direction; and a control unit which controls a scanning operation so that k main scanning operations are performed within the interval D, where k is an integer equal to or greater than 2, wherein a part of an area recorded by the nth main scanning operation is overlapped with a part of an area recorded by the (n+k)th main scanning operation, where n is an integer equal to or greater than 1; and a part of dots included in the overlapping area is recorded by the nth main scanning operation so that the rest of the dots included in the overlapping area are complementarily recorded by the (n+k)th main scanning operation.

According to the above-mentioned invention, since the overlapping area is provided in a boundary between the area recorded by the nth main scanning operation and the area recorded by the (n+k)th main scanning operation, unevenness in the density of the dot image such as a white band is reduced in the boundary area.

In the above-mentioned inkjet recording apparatus, the control unit may include:

a memory storing a banding pattern table used for the complementary recording, the banding pattern table being defined by a matrix "R×C", where R is a number of rows of the dots included in said overlapping area and C is a number of dots arranged in the main scanning direction; and a determining unit determining whether each of the dots included in the overlapping area is to be recorded by the nth main scanning operation or the (n+k)th main scanning operation, wherein a size of the banding pattern table is greater than "2×3" or "3×2".

According to this invention, the overlapping area is complementarily recorded by both the nth main scanning operation and the (n+k)th main scanning operation in accordance with the banding pattern table having a size greater than "2×3" or "3×2". Thus, a band-like unevenness in the density of the image in the boundary area can be easily diffused, which results in a high-quality image.

Additionally, there is provided according to another aspect of the present invention an inkjet recording apparatus for recording a dot image on a recording medium by using an interlace recording method, the inkjet recording apparatus comprising:

a recording head having a plurality of nozzles arranged at a uniform interval D in a sub-scanning direction;

a moving mechanism for moving the recording medium in the sub-scanning direction; and a control unit which controls a scanning operation so that k times main scanning operations are performed within the interval D, where k is an integer equal to or greater than 2, wherein a part of an area recorded by the nth main scanning operation is overlapped with a part of an area recorded by the (n+m1×k)th main scanning operation so as to form an overlapping area, where n is an integer equal to or greater than 1 and m1 is a number of nozzles used for recording a single line;

a part of dots included in the overlapping area is recorded by the nth main scanning operation so that the rest of the dots included in the overlapping area are complementarily recorded by the (n+m1×k)th main scanning operation;

a number of nozzles N is represented by the following equation:

$$N=m\mathbf{1}\times(k\times m\mathbf{2}+a)+Nov$$

where Nov is a number of rows included in the overlapping area, m2 is an integer equal to or greater than 1 and a is an integer equal to or greater than 1, and an amount of shift S of the recording head in the sub-scanning direction is represented by the following equation:

$$S=(m\mathbf{2}+a/k)\times D.$$

In this invention, a single line in the main scanning operation is recorded by a plurality of nozzles and a boundary area between an area recorded by the nth main scanning operation and the (n+m1×k)th main scanning operation is complementarily recorded by both the nth main scanning operation and the (n+m1×k)th main scanning operation. Thus, unevenness in the density of the dot image such as a white band is reduced in the boundary area.

According to another aspect of the present invention, there is provided an inkjet recording method performed by the above-mentioned inkjet recording apparatus.

Additionally, there is provided according to another aspect of the present invention a processor readable medium storing a printer driver which controls the inkjet recording apparatus to perform the inkjet recording method.

Other objects, features and advantages of the present invention will become more apparent from the following detailed description when read in conjunction with the accompanying drawings.

BRIEF DESCRIPTION OF THE DRAWINGS

FIG. 9 is an illustration of a dot image having no overlapping area;

FIG. 10A is an illustration of a dot image having an overlapping area recorded in accordance with a 2×2-matrix banding pattern; FIG. 10B is an illustration showing the 2×2-matrix banding pattern;

FIG. 14 is an illustration of a 10×642-matrix banding pattern;

DETAILED DESCRIPTION OF THE PREFERRED EMBODIMENTS

A description will now be given of a first embodiment of the present invention.

Figure 1:
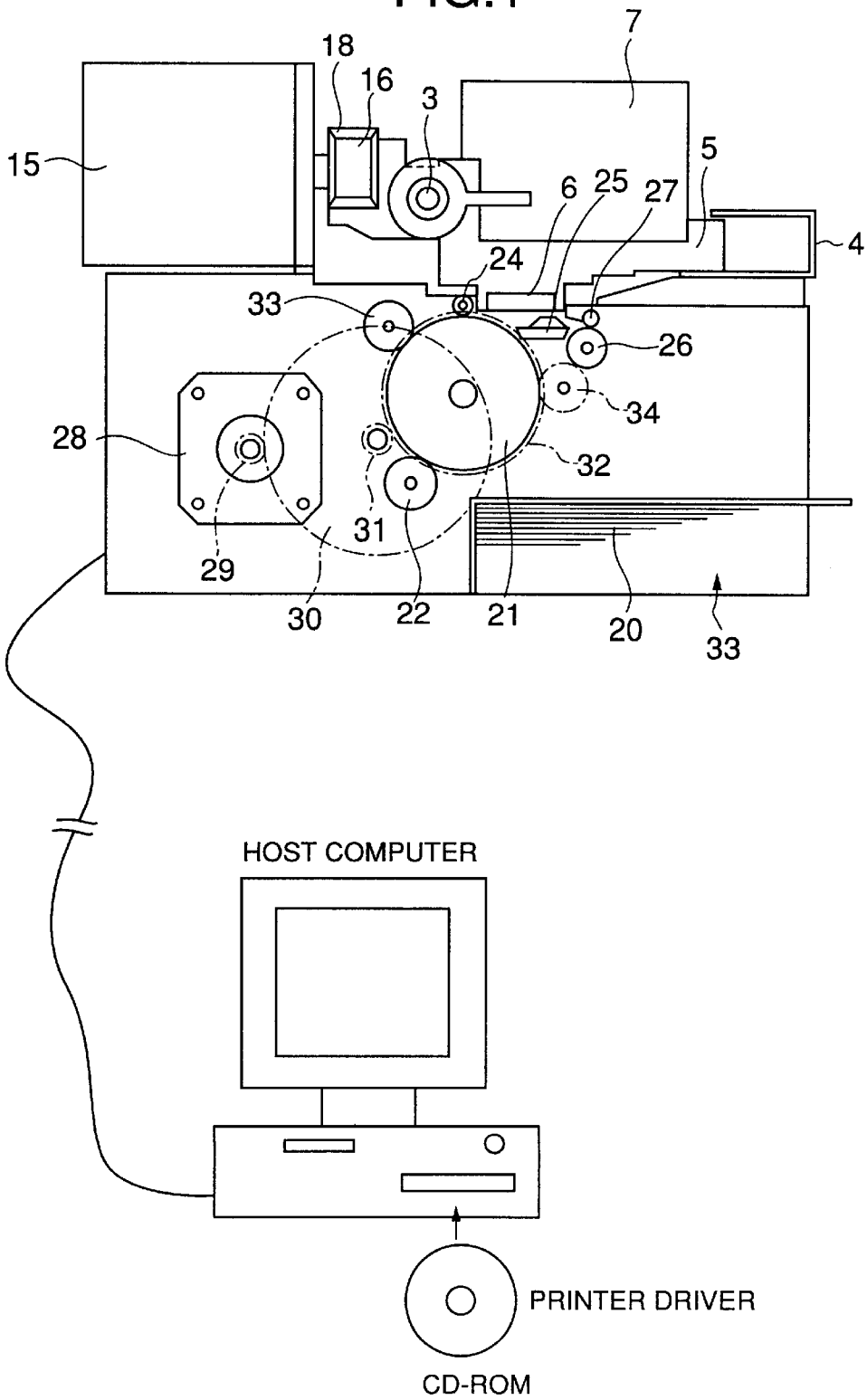
FIG. 1 is an illustration of a structure of an inkjet recording apparatus according to a first embodiment of the present invention.
Figure 2:
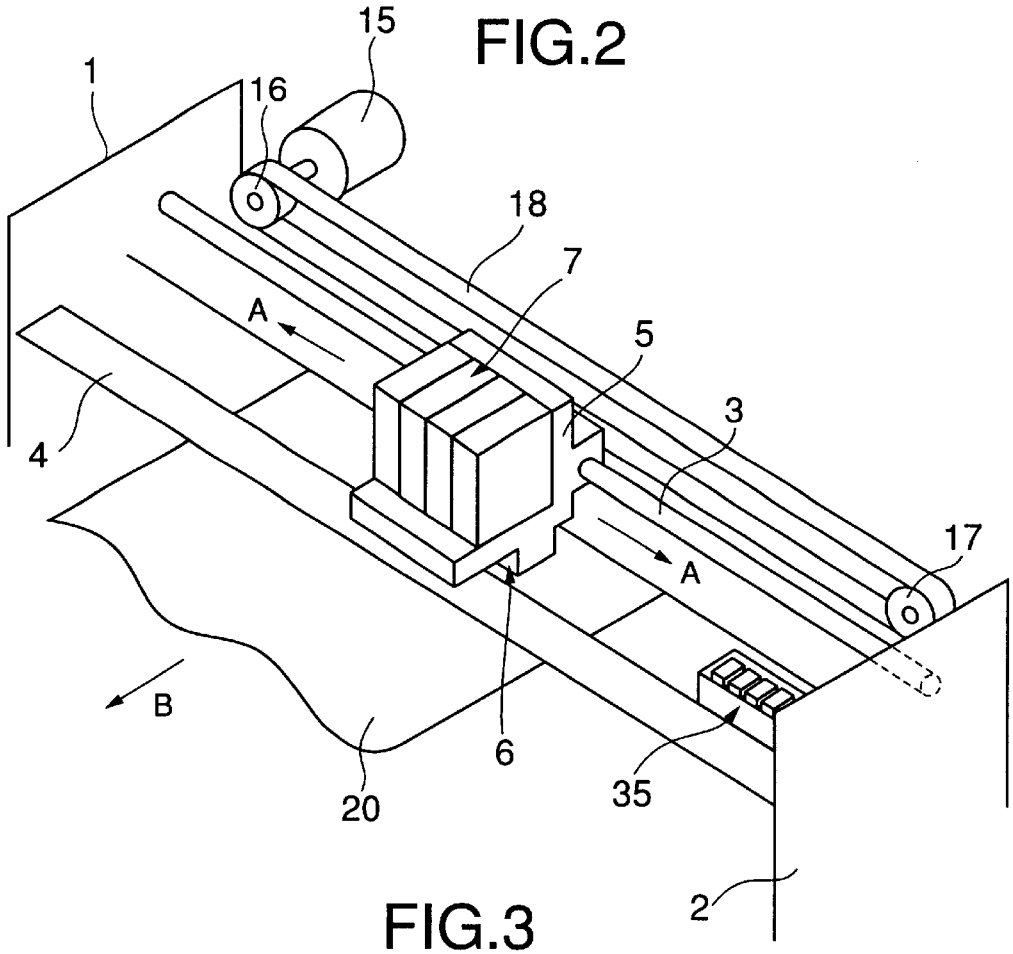
FIG. 2 is a perspective view of a part of the inkjet recording apparatus shown in FIG. 1.
Figure 3:
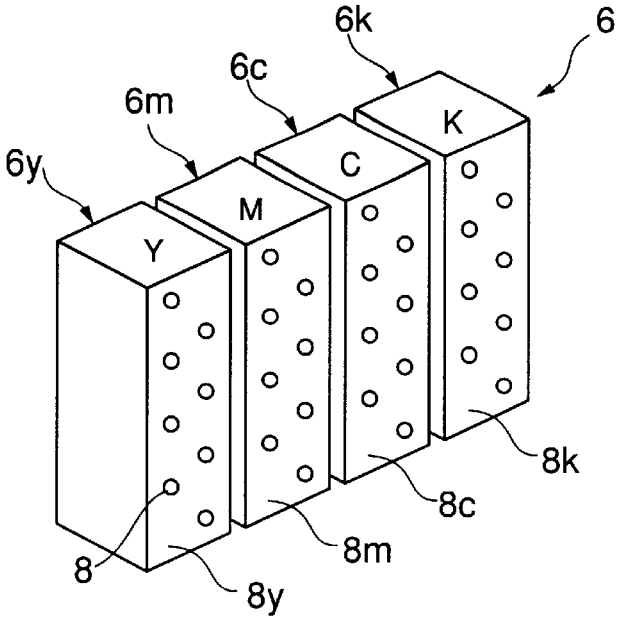
FIG. 3 is a perspective view of a recording head shown in FIG. 2.
Figure 4:
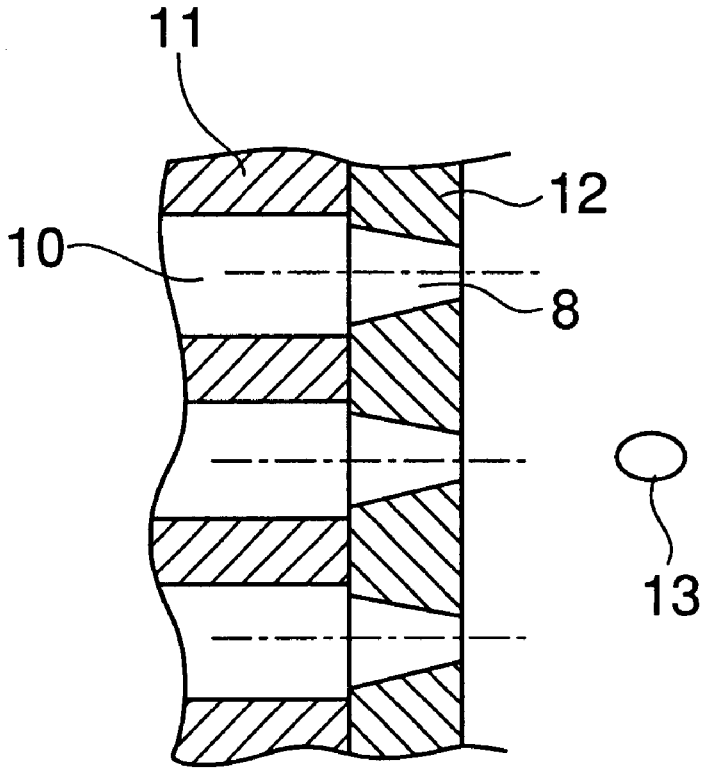
FIG. 4 is a cross-sectional view of a part of the recording head shown in FIG. 3.

FIG. 1 is an illustration of a structure of an inkjet recording apparatus according to the first embodiment of the present invention. FIG. 2 is a perspective view of a part of the inkjet recording apparatus shown in FIG. 1. FIG. 3 is a perspective view of a recording head shown in FIG. 2. FIG. 4 is a cross sectional view of a part of the recording head shown in FIG. 3.

In the inkjet recording apparatus shown in FIG. 1, a carriage 5 is slidably supported by a guide rod 3 and a guide plate 4 that extend between side plates 1 and 2 (shown in FIG. 2). The carriage 5 is movable in directions indicated by arrows A in FIG. 2. A recording head 6 is provided on a lower part of the carriage 5 so that ink drops are projected in a downward direction. An ink tank (ink cartridge) 7 is located on a top side of the carriage 5 so as to supply color ink to the recording head 6.

As shown in FIG. 1, the inkjet recording apparatus is connected to a host computer so that a printing operation of the inkjet recording apparatus is controlled by a printer driver installed in the host computer. The printer driver may be provided to the host computer by a processor readable medium such as a CD-ROM.

As shown in FIG. 3, the recording head 6 comprises four heads 6*y*, 6*m*, 6*c* and 6*k*. The head 6*y* has a plurality of nozzles 8*y* each of which discharges yellow (Y) ink. The head 6*m* has a plurality of nozzles 8*m* each of which discharges magenta (M) ink. The head 6*c* has a plurality of nozzles 8*c* each of which discharges cyan (C) ink. The head 6*k* has a plurality of nozzles 8*k* each of which discharges black (Bk) ink. The heads 6*y*, 6*m*, 6*c* and 6*k* are arranged in a main scanning direction, and a train of each of the nozzles 8*y*, 8*m*, 8*c* and 8*k* is arranged in a sub-scanning direction. Hereinafter, the nozzles 8*y*, 8*m*, 8*c* and 8*k* may be referred to as nozzles 8 as a whole. It should be noted that the ink cartridge 7 comprises four independent cartridges that store respective color ink.

As show in FIG. 4, each of the heads 6*y*, 6*m*, 6*c* and 6*k* comprises a liquid chamber forming member 11 forming a plurality of liquid chambers 10 and a nozzle forming member 12 attached in front of the liquid chamber forming member 11. The recording nozzles 8 are formed in the nozzle forming member 12 so that the recording nozzles 8 are connected to the respective liquid chambers 10. Ink is supplied from the respective ink cartridge to each of the liquid chambers 10, and the ink in each of the liquid chambers 10 is pressurized by an energy generating unit (not shown in the figure) such as a piezoelectric element or a bubble generating heater. The pressurized ink is discharged from the recording nozzles 8 of the nozzle forming member 12. The discharged ink forms an ink drop 13 and is projected onto a recording medium such as a recording paper to form a dot on the recording paper. A desired image can be formed on the recording paper by selectively driving the energy generating unit connected to each of the liquid chambers 10.

It should be noted that although the inkjet recording apparatus according to the present embodiment comprises the four color heads and ink cartridges, other heads and cartridges for different colors may be added.

Referring to FIGS. 1 and 2, the carriage 5 including the recording head 6 is movable in a main scanning direction by being engaged with a timing belt 18 which is drivingly engaged with a drive pulley 16 and an idle pulley 17. The drive pulley 16 is rotated by a main scanning motor 15 which is a stepping motor.

The inkjet recording apparatus also includes a recording paper feeding mechanism which comprises a convey roller 21, paper feed rollers 22 and 23, a pinch roller 24, a guide plate 25, an eject roller 26 and a paper pressing roller 27. The convey roller 21 conveys a recording paper 20 in a sub-scanning direction indicated by an arrow B in FIG. 2. The feed rollers 22 and 23 presses the recording paper 20 onto the convey roller 21. The pinch roller 24 defines a paper feed angle. The guide plate 26 is located opposite to the recording head 6. The eject roller 26 is located on a downstream side of the recording head 6. The paper pressing roller 27 is pressed against the eject roller 26.

A rotational force generated by a sub-scanning motor 28 is transmitted to the convey roller 21 via gears 29, 30, 31 and 32 so as to rotate the convey roller 21. Thus, the recording paper carried by the convey roller 21 is moved to a gap between the recording head 6 and the guide plate 25 via the feed rollers 22 and 23 and the pinch roller 24. The recording paper 20 passing through the gap is caught by the eject roller 26 and the paper pressing roller 27, and the recording paper 20 is fed in a paper eject direction (indicated by the arrow B in FIG. 2).

In the inkjet recording apparatus having the above-mentioned structure, ink drops in selected colors are projected onto the recording paper 20 from the heads 6*y*, 6*m*, 6*c* and 6*k* of the recording head 6 by moving the recording head 6 (carriage 5) in the main scanning direction and simultaneously moving the recording paper 20 in the sub-scanning direction so as to form a color image (or monochrome image) on the recording paper 20.

Additionally, in the inkjet recording apparatus, a maintenance mechanism 35 is provided on the right side of a main scanning area of the carriage 5. The maintenance mechanism 35 performs a maintenance operation of the recording head 6 at a time when a recording operation is not performed for a predetermined period or at a predetermined time interval. The maintenance operation includes an operation for cleaning dirt on a nozzle surface or each nozzle 8.

Figure 5:
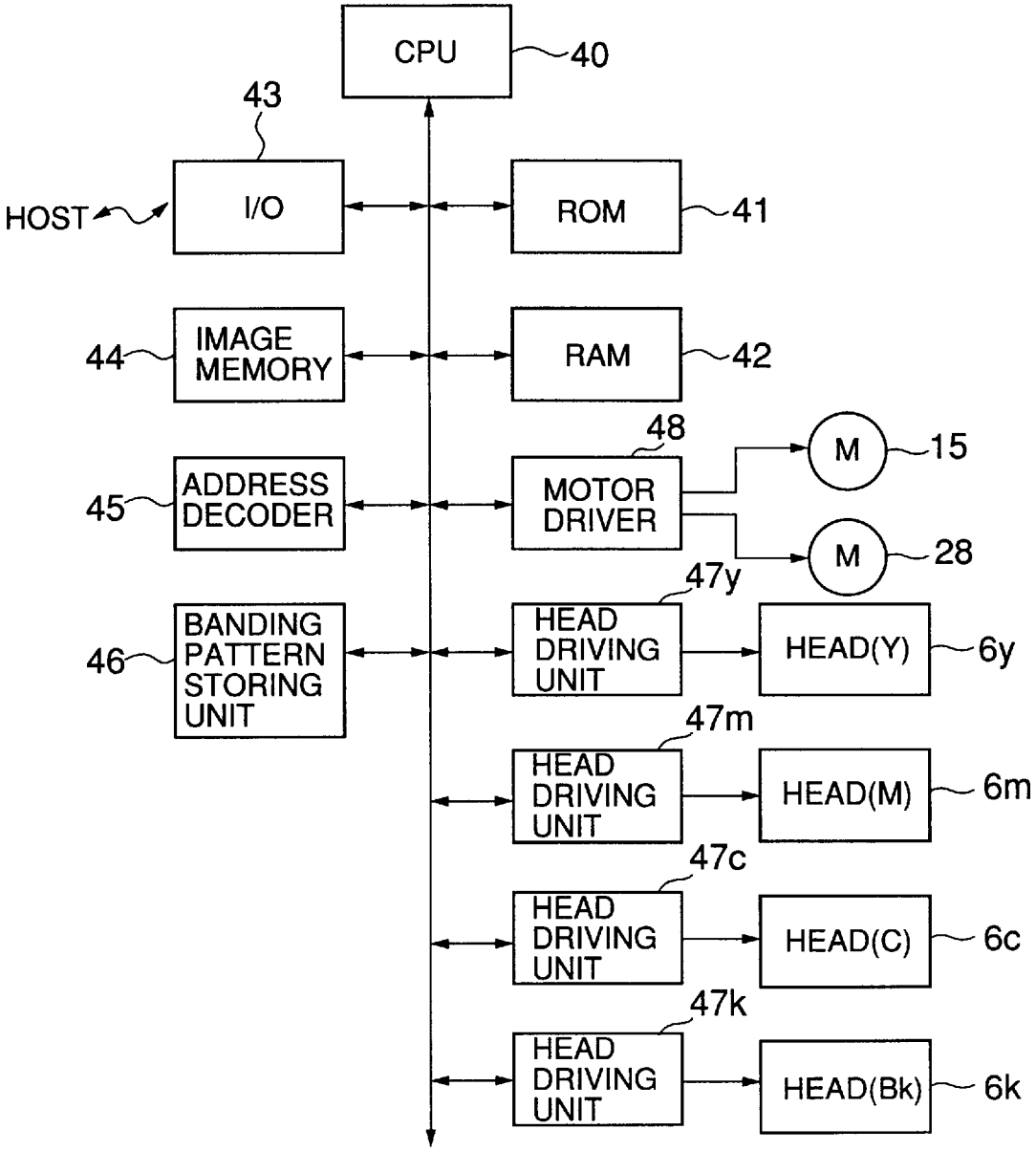
FIG. 5 is a block diagram of a control unit for controlling an operation of the inkjet recording apparatus shown in FIG. 1.

A description will now be given, with reference to FIG. 5, of a control unit of the inkjet recording apparatus. FIG. 5 is a block diagram of the control unit for controlling an operation of the inkjet recording apparatus shown in FIG. 1.

As shown in FIG. 5, the control unit comprises a microcomputer (CPU) 40, a ROM 41, a RAM 42, an input/output (I/O) port 43, an image memory 44, an address decoder 45, a banding pattern storing unit 46, head driving units 47*y*, 47*m*, 47*c* and 47*k* and a motor driver 48. The CPU 40 controls the entire apparatus. The ROM 41 stores information necessary for operations of the CPU 40. The RAM 42 is used as a working area for the CPU 40. The I/O port 43 exchanges data with a printer controller provided in a host computer. The image memory 44 stores image data sent from the print controller. The address decoder 45 decodes address data supplied by the CPU 40. The banding pattern storing unit 46 stores information regarding a banding pattern that will be described later. The head driving units 47*y*, 47*m*, 47*c* and 47*k* drive the respective heads 6*y*, 6*m*, 6*c* and 6*k*. The motor driver 48 controls the main scanning motor 15 and the sub-scanning motor 28. It should be noted that the banding pattern storing unit 46 can be constituted by a ROM in which firmware is written, hardware constituting a logic circuit and a RAM.

In the control unit, the image data stored in the image memory 44 is read and transferred to the head driving units 47*y*, 47*m*, 47*c* and 47*k*. Additionally, the address data is supplied from the CPU 40 to the address decoder 45 so as to store the banding pattern in the banding pattern storing unit 46. Each of the head driving units 47*y*, 47*m*, 47*c* and 47*k* temporarily stores print data in a buffer provided therein. The print data is produced based on the image data and the banding pattern data. Each of the head driving units 47*y*, 47*m*, 47*c* and 47*k* sends the print data to the respective heads 6*y*, 6*m*, 6*c* and 6*k* when a predetermined amount of print data is stored in the buffer. The CPU 40 outputs a drive control signal to the motor driver 48 so as to move the carriage 5 in the main scanning direction and move the recording paper 20 by a predetermined distance in the sub-scanning direction by rotating the convey roller 21.

Figure 6:
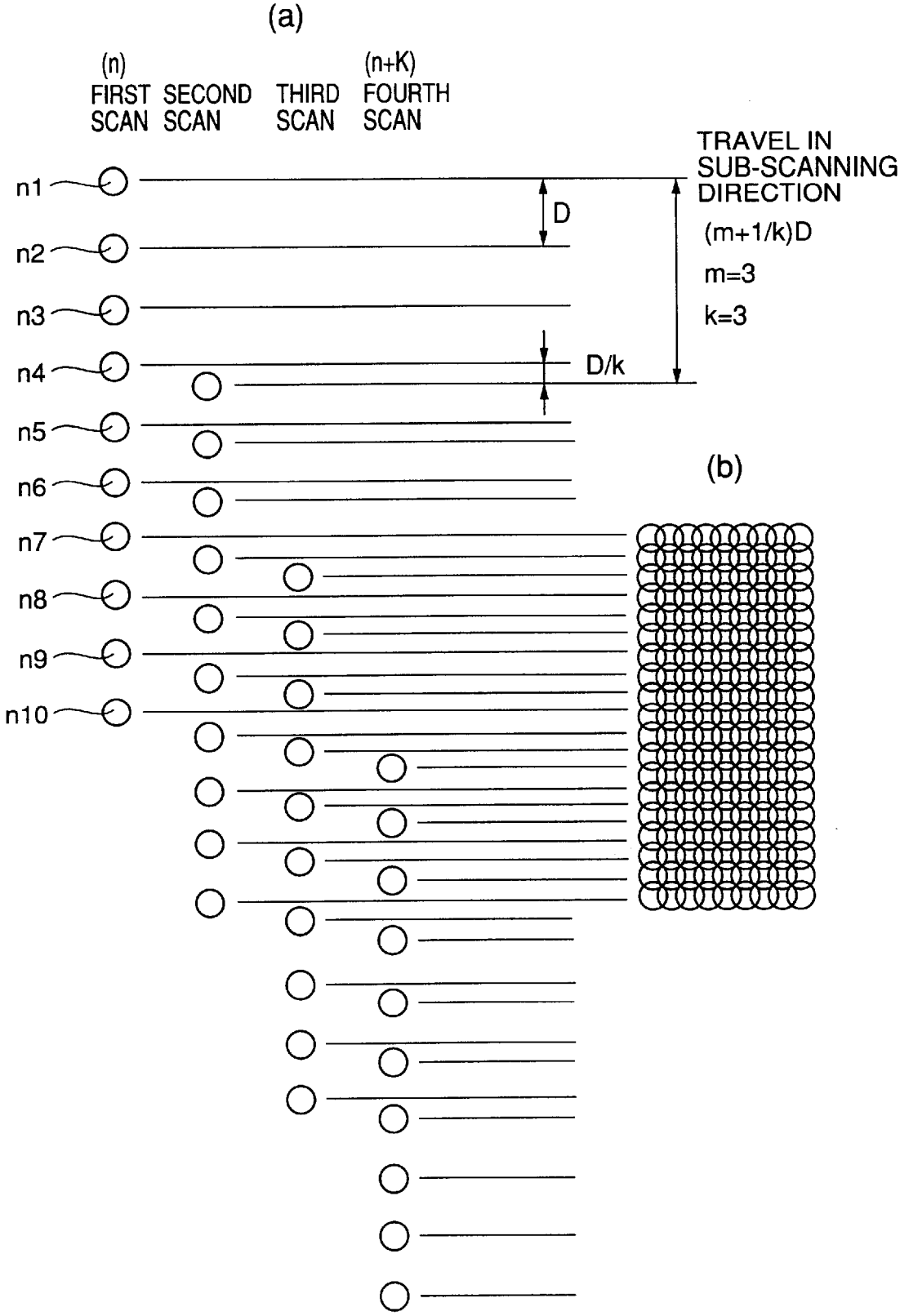
FIG. 6 is an illustration for explaining a basic example of an interlace printing method.

A description will now be given, with reference to FIG. 6, of an interlace printing method. FIG. 6 is an illustration for explaining a basic example of the interlace printing method.

In the interlace printing method shown in FIG. 6, 10 nozzles n1 to n10 are arranged in the sub-scanning direction. The nozzles n1 to n10 are arranged at an interval D. The image is recorded by performing k main scanning operations with a uniform line shift by $(m+a/k)\times D$, where m is an integer equal to or greater than 1 ($m\geqq 1$), a/k is an irreducible fraction, k is an integer equal to or greater than 2 ($k\geqq 2$).

In the present embodiment, the number of nozzles is 10 (n1 to n10), and the interval of the nozzles is D. The constant m is set to 3 (m=3), and the irreducible fraction a/k is set to ⅓, that is, the number k is set to 3 (k=3). Accordingly, an amount of shift of the recording head (nozzles) in the sub-scanning direction is $(m+1/k)\times D=(3+⅓)\times D$.

As shown in FIG. 6-(*a*), the nozzles n7 to n10 are used to print the dots in the first main scanning operation. The second main scanning operation is performed after the recording paper is shifted in the sub-scanning direction by the distance $(3+⅓)\times D$. In the second scanning operation, the nozzles n4 to n10 are used. Thereafter, the recording paper is shifted in the sub-scanning direction by the distance $(3+⅓)\times D$, and the third main scanning operation is performed by using all of the nozzles n1 to n10. Thereafter, the fourth and subsequent main scanning operations are performed in the same manner by using all of the nozzles n1 to n10.

As mentioned above, according to the interlace printing method shown in FIG. 6, a recording with a dot pitch D/k=D/3 can be performed by using the recording head having nozzles arranged at the interval D. In this case, if each shift D/k=D/3 of the recording head in the sub-scanning direction is very accurate, an ideal dot pattern having no unevenness in image density can be obtained as shown in FIG. 6-(*b*).

However, in practice, it is very difficult to obtain such an accuracy in the shift of the recording head. Additionally, variation in a thickness of the recording paper and an eccentricity of the convey roller may influence the accuracy in the shift of the recording head in the sub-scanning direction. Accordingly, there may be an error occurring in the shift of the recording head in the.sub-scanning direction.

Figure 7:
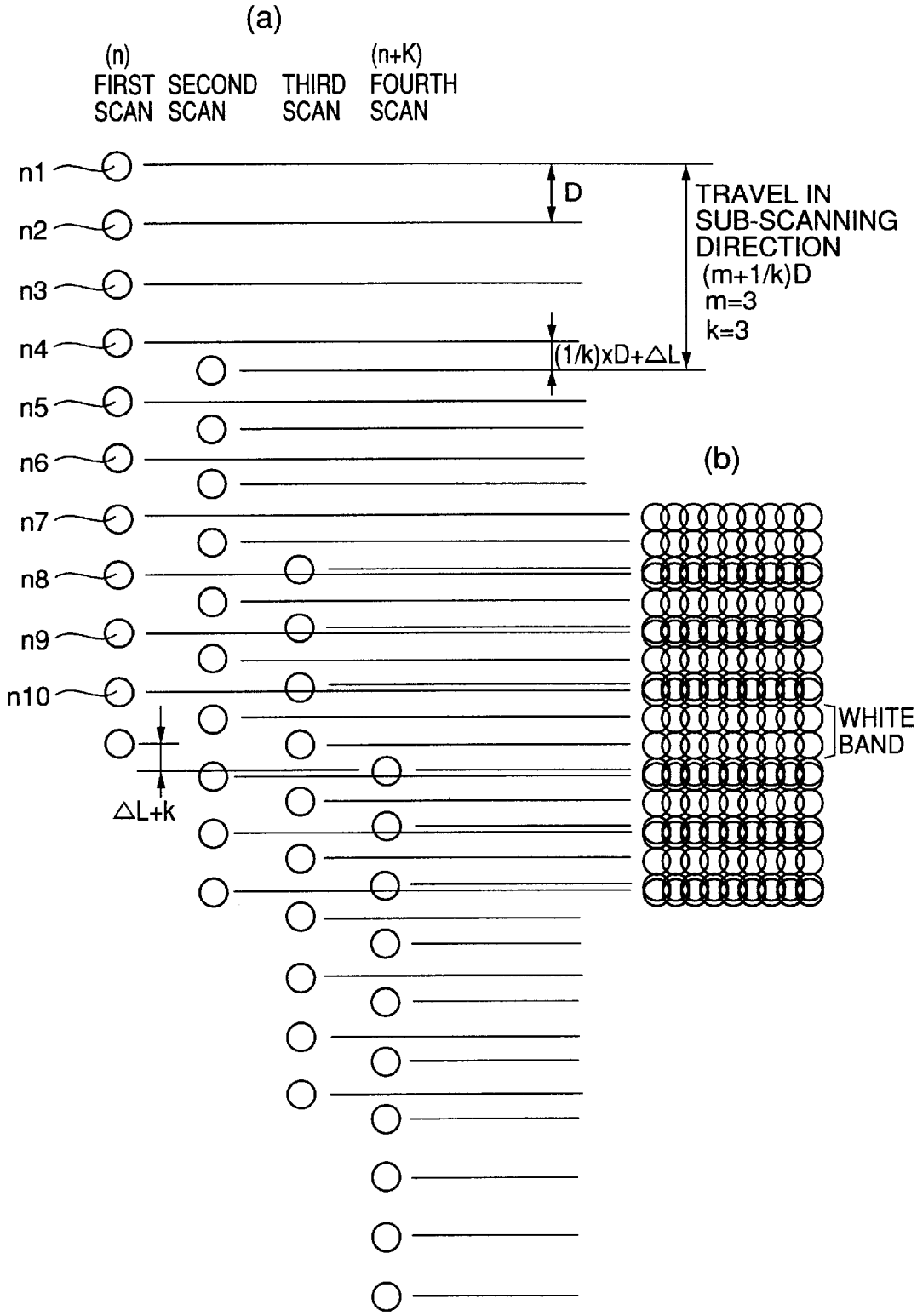
FIG. 7 is an illustration for explaining a problem of the interlace printing method shown in FIG. 6.

FIG. 7 is an illustration similar to FIG. 6 when an error occurs in the shift of the recording head in the sub-scanning direction. In FIG. 7, the amount of shift of the recording head in the sub-scanning direction is increased by an error $\Delta L$. In this case, unevenness occurs in the density of the recorded dot pattern as shown in FIG. 7-(*b*).

In the above-mentioned unevenness in the density of the dot image, a band-like low-density area (generally referred to as a white band) is most remarkable. The white band occurs due to a position of the recording nozzle n1 being shifted by a distance ($\Delta L\times k$) from a normal position when the (n+k)th main scanning operation is performed.

A description will now be given, with reference to FIG. 8, of an interlace printing method used in the inkjet recording apparatus according to the present embodiment.

In the present embodiment, the number N of the nozzles is set as $N=k\times m+a+Nov$, where $k>a\geqq 1$, a/k is an irreducible fraction, m is an integer equal to or greater than 1 ($m\geqq 1$) and Nov is a number of overlapping nozzles. The shift of the recording head in the sub-scanning direction is $(m+a/k)\times D$. In the present embodiment, a part of an area recorded by the nth main scanning operation is overlapped with a part of an area recorded by the (n+k)th main scanning operation so that a recording of the overlapping area is complemented by one of the nth main scanning operation and the (n+k)th scanning operation. This method is referred to as a complement printing.

Figure 8:
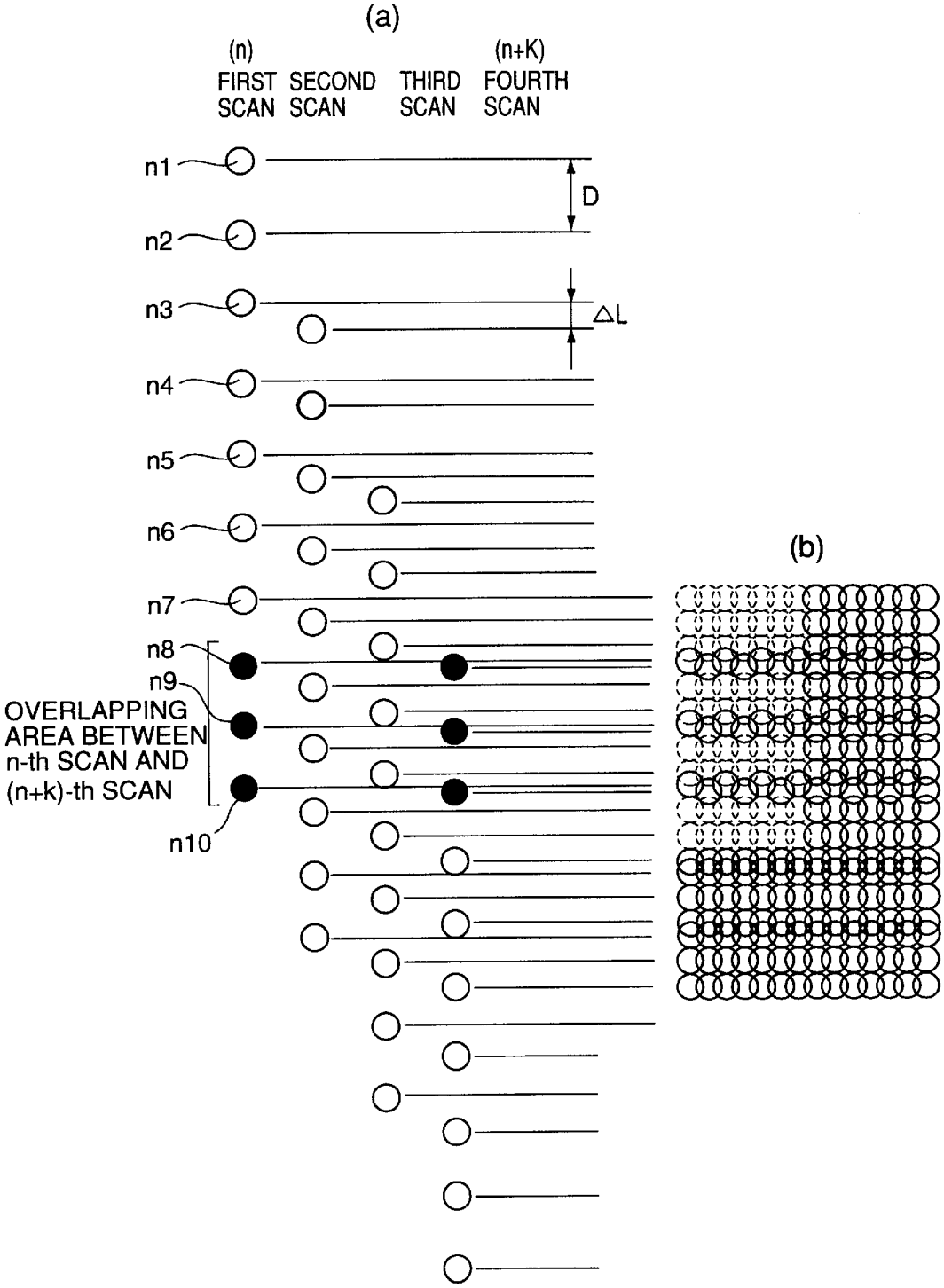
FIG. 8 is an illustration for explaining an interlace printing method according to the first embodiment of the present invention.

More specifically, as shown in FIG. 8-(*a*), k is set to 3 (k=3), m is set to 2 (m=2), a is set to 1 (a=1) and the number of overlapping nozzles Nov is set to 3 (Nov=3). Accordingly, the number N of nozzles is ten ($N=k\times m+a+Nov=(3\times 2+1+3)=10$). That is, ten nozzles n1 to n10 are provided. As indicated by circles painted in black, the number of nozzles forming the overlapping area is 3. That is, an area recorded by the nozzles n8, n9 and n10 in the first main scanning operation is overlapped with an area recorded by the nozzles n1, n2 and n3 in the fourth main scanning operation. It should be noted that a part of dots shown in FIG. 8-(*b*) is indicated by dashed lines so that the positional relationship between the adjacent dots can be clearly indicated.

In the above-mentioned method, the complement printing means that the recording of the overlapping area created by the nth main scanning operation and the (n+k)th main scanning operation is completed by recording a part of the dots to be printed in the overlapping area by the nth main scanning operation and recording the rest of the dots to be printed in the overlapping area by the (n+k)th main scanning operation. It should be noted that whether or not the dots are actually recorded is dependent on print data corresponding to an image to be formed on the recording paper.

The above-mentioned process for eliminating the unevenness is referred to as a banding process. If the banding process is not performed, that is, if the complement printing is not performed, the nth (first) main scanning operation and the (n+k)th (fourth) main scanning operation are performed without providing the overlapping area as shown in FIG. 9. In this case, when an amount of shift in the sub-scanning direction is larger than a preset amount of shift, a white band (light band) appears between the area recorded by the nth main scanning operation and the area recorded by the (n+k)th main scanning operation. On the other hand, when an amount of shift in the sub-scanning direction is smaller than the preset amount of shift, a black band (dark band) appears between the area recorded by the nth main scanning operation and the area recorded by the (n+k)th main scanning operation.

Figure 15A:
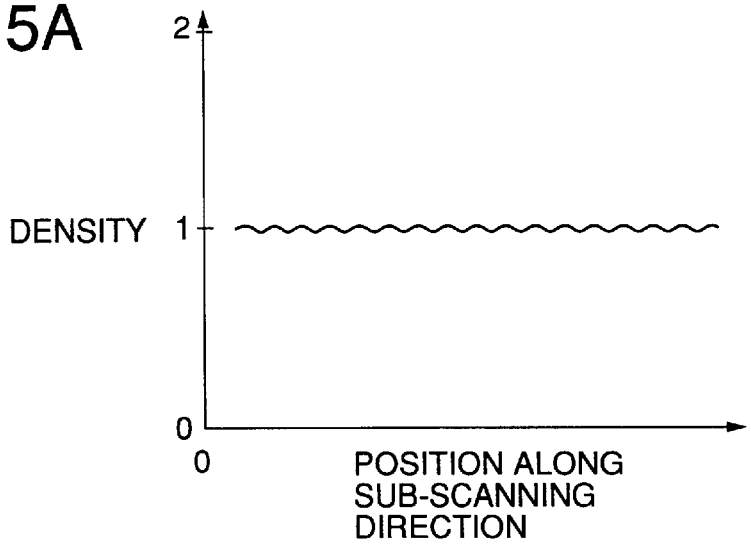
FIGS. 15A, 15B, 15C, 15D, 15E and 15F are graphs showing results of measurement of a recorded image by a micro-densitometer.
Figure 15B:
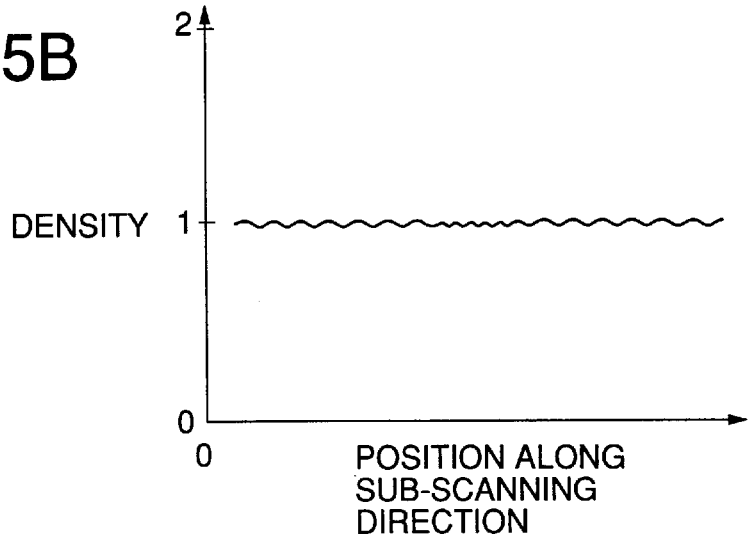
Figure 15C:
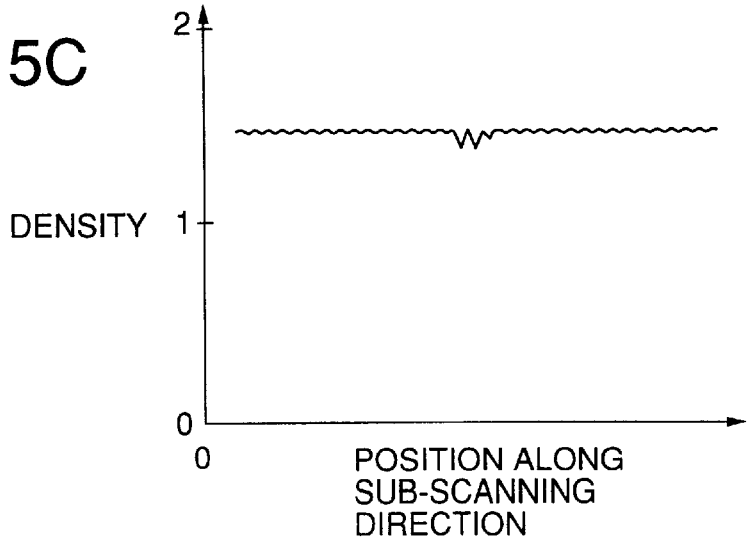
Figure 15D:
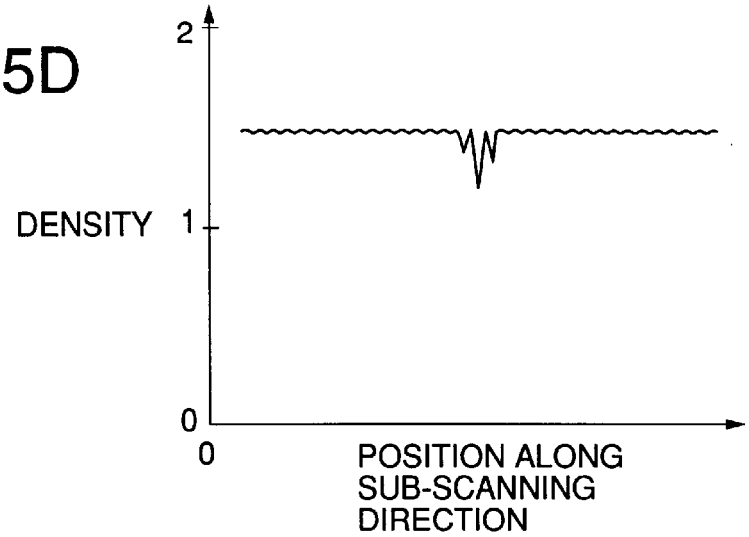
Figure 15E:
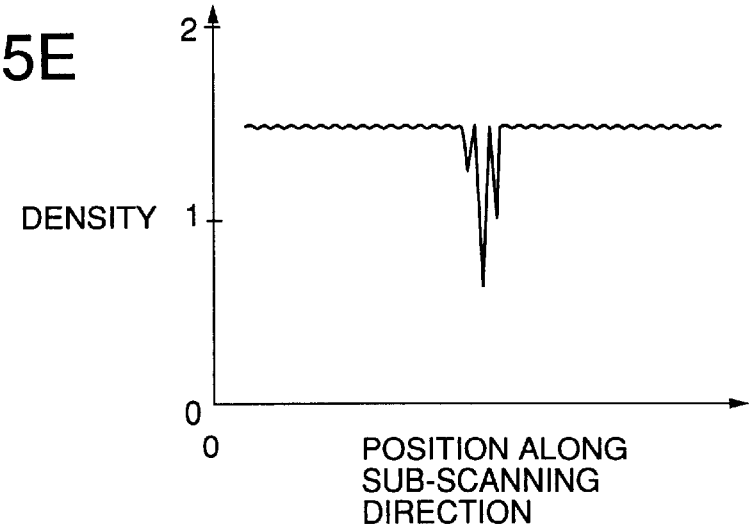
Figure 15F:
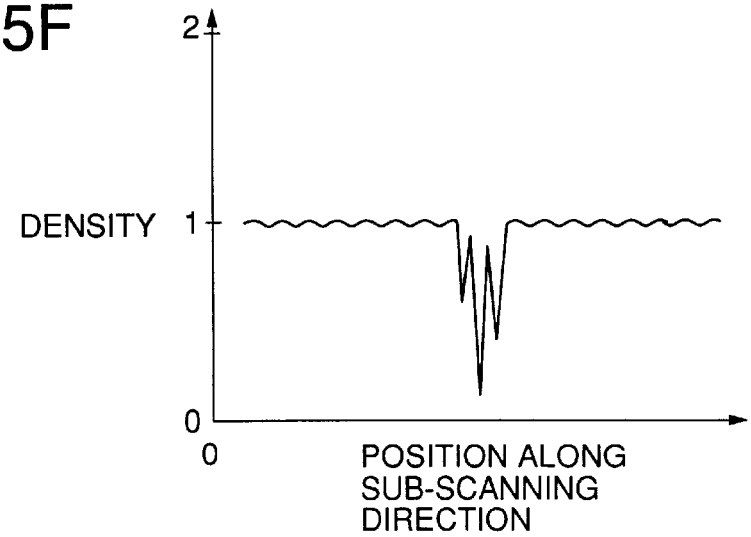

When the density of the image recorded by the method providing no overlapping area as shown in FIG. 9 is measured by a micro-densitometer, a result of the measurement becomes as shown in FIG. 15F. That is, a large white band is measured. It should be noted that FIG. 15A shows a result of measurement by the micro-densitometer when no white band is generated in a recorded image.

FIG. 10A shows a case in which an overlapping area in which 2 rows of the dots are included is created by the nth (first) main scanning operation and the (n+k)th (fourth) main scanning operation. In this case, dots indicated by black circles in the overlapping area are recorded in the nth (first) main scanning operation, and dots indicated by white circles in the overlapping area are recorded in the (n+k)th main scanning operation. The dot pattern in the overlapping area can be created in accordance with a banding pattern by using a banding pattern table. The dot pattern shown in FIG. 10A is created by a "2×2" banding pattern as shown in FIG. 10B. In this case, a result of measurement by the micro-densitometer is shown in FIG. 15E. FIG. 15E indicates that a white band having a strong intensity appears in the recorded image.

Figures 11A, 11B:
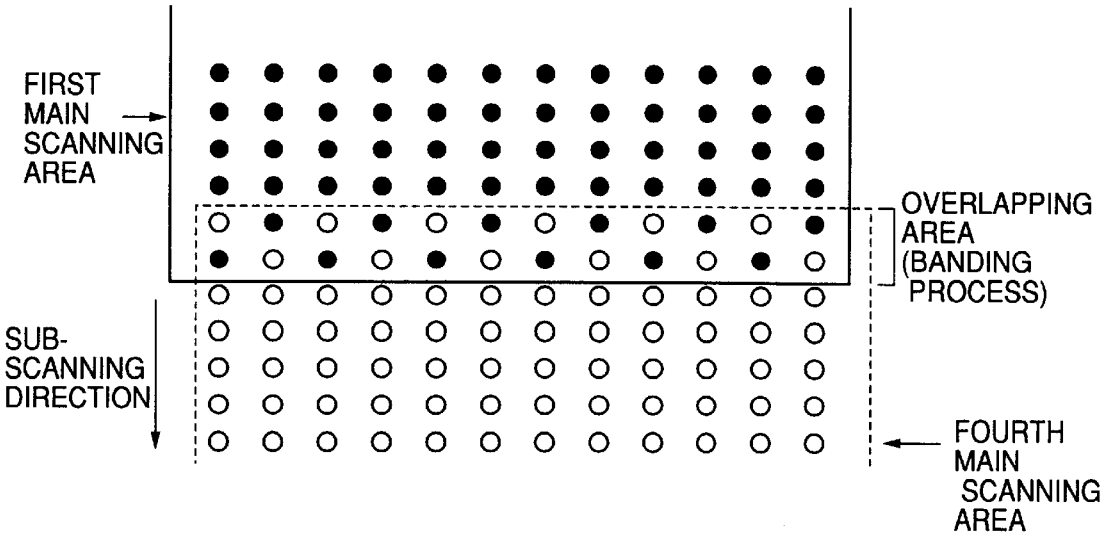
FIG. 11A is an illustration of a dot image having an overlapping area recorded in accordance with a 2×3-matrix banding pattern.
FIG. 11B is an illustration showing the 2×3-matrix banding pattern.

FIG. 11A shows a case in which an overlapping area including 2 rows of the dots is created by the nth (first) main scanning operation and the (n+k)th (fourth) main scanning operation. In this case, dots indicated by black circles in the overlapping area are recorded in the nth (first) main scanning operation, and dots indicated by white circles in the overlapping area are recorded in the (n+k)th main scanning operation. The dot pattern shown in FIG. 11A is created by a "2×3" banding pattern as shown in FIG. 11B. In this case, a result of measurement by the micro-densitometer is shown in FIG. 15D. FIG. 15D indicates that the white band still appears in the recorded image but the intensity of the white band is reduced.

Figures 12A, 12B, 13:
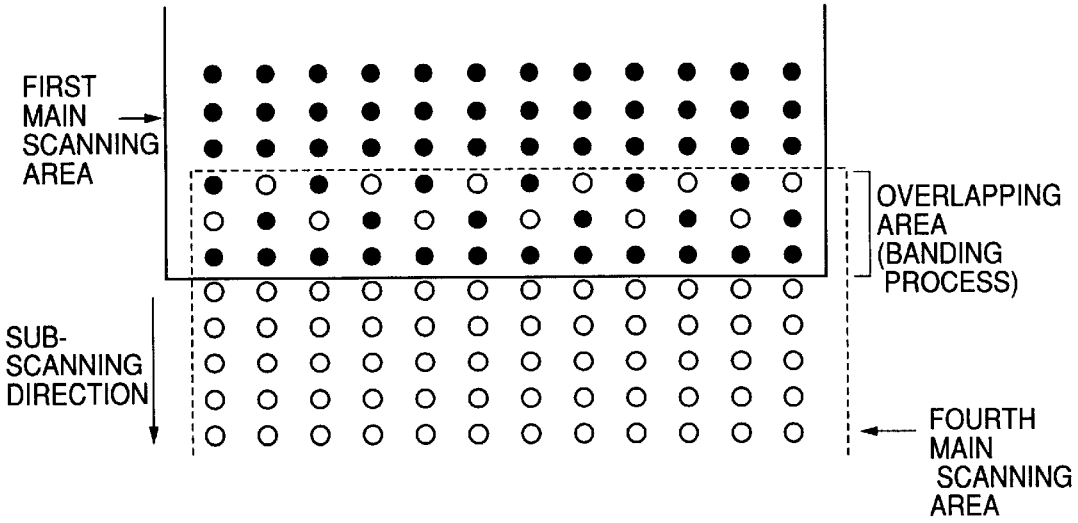
FIG. 12A is an illustration of a dot image having an overlapping area recorded in accordance with a 3×2-matrix banding pattern.
FIG. 12B is an illustration showing the 3×2-matrix banding pattern.
FIG. 13 is an illustration of a 5×32-matrix banding pattern.

FIG. 12A shows a case in which an overlapping area including 3 rows of the dots is created by the nth (first) main scanning operation and the (n+k)th (fourth) main scanning operation. In this case, dots indicated by black circles in the overlapping area are recorded in the nth (first) main scanning operation, and dots indicated by white circles in the overlapping area are recorded in the (n+k)th main scanning operation. The dot pattern shown in FIG. 12A is created by a "3×2" banding pattern as shown in FIG. 12B. In this case, a result of measurement by the micro-densitometer is shown in FIG. 15D.

FIG. 13 shows a "5×32" banding pattern. In a case in which the matrix pattern shown in FIG. 13 is used, result of measurement by the micro-densitometer becomes as that shown in FIG. 15C. FIG. 15C indicates that the intensity of the white band is reduced further than that shown in FIG. 15D.

Additionally, FIG. 14 shows a "10×642" banding pattern. In a case in which the matrix pattern shown in FIG. 14 is used, a result of measurement by the micro-densitometer becomes as that shown in FIG. 15B. FIG. 15B indicates that the intensity of the white band is reduced further than that shown in FIG. 15C.

It is assumed that the following band rank is given to the magnitude of the results of measurement obtained by the micro-densitometer.

Rank 5 . . . FIG. 15A
Rank 4 . . . FIG. 15B
Rank 3 . . . FIG. 15C
Rank 2 . . . FIG. 15D
Rank 1 . . . FIG. 15E
Rank 0 . . . FIG. 15F Additionally, sensory rank is defined with respect to the band rank as indicated in FIG. 16.

Rank 5 . . . very good
Rank 4 . . . good
Rank 3 . . . little good
Rank 2 . . . little bad
Rank 1 . . . bad
Rank 0 . . . vary bad It is assumed that an image has a good quality if the band rank is equal to or higher than the level 4.

Figure 16:
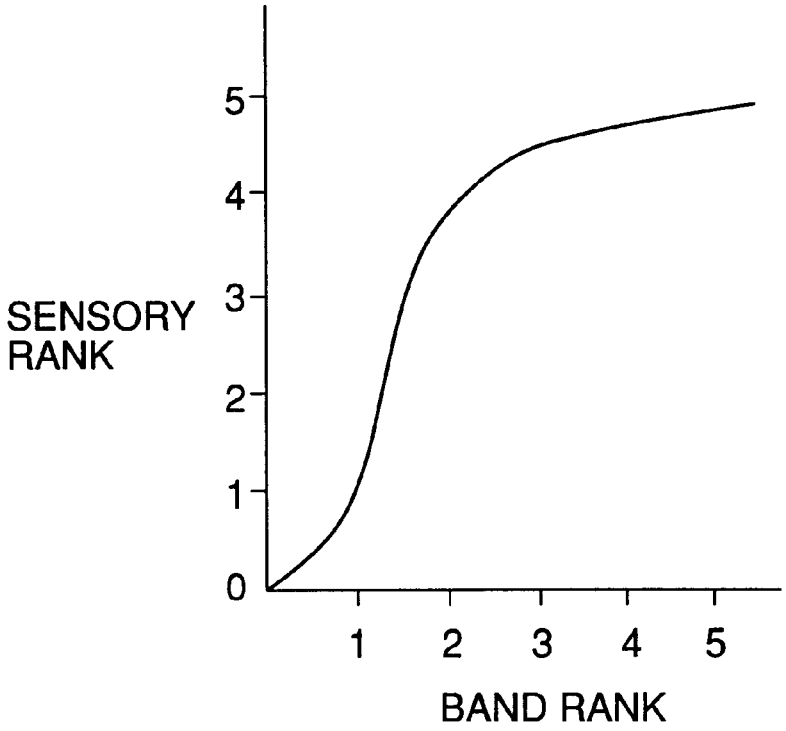
FIG. 16 is a graph showing a relationship between band rank and sensory rank.

According to the relationship between the band rank and the sensory rank shown in FIG. 16, the sensory rank is equal to or higher than the level 4 when the band rank is equal to or higher than level 2. The band rank 2 is achieved by the "2×3" banding pattern or the "3×2" banding pattern. This means that if a matrix banding pattern equal to or greater than the "2×3" banding pattern or the "3×2" banding pattern is used, the band-like unevenness (banding) generated in a boundary area between series of scanning areas can be dispersed, which results in a high-quality image having less unevenness in the image density.

Figure 17:
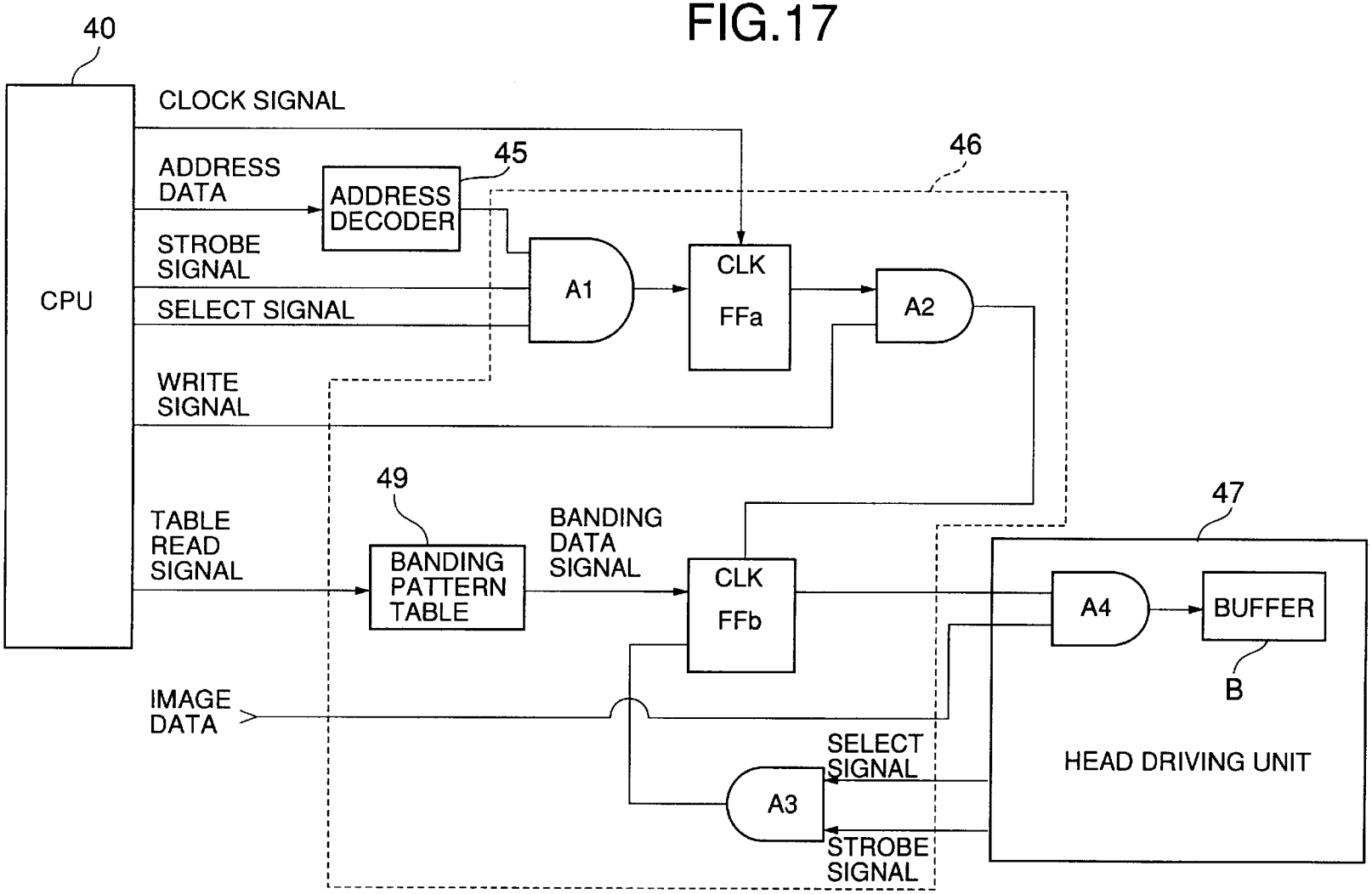
FIG. 17 is a circuit diagram of a part of a banding pattern storing unit shown in FIG. 5 which part corresponding to a circuit for processing a single dot.

A description will now be given, with reference to FIGS. 17 and 18, of a structure of a circuit producing the above-mentioned banding pattern and an operation of the circuit. FIG. 17 is a circuit diagram of a part of a banding pattern storing unit 46 shown in FIG. 5 which part corresponding to a circuit for processing a single dot.

The banding pattern storing unit 46 shown in FIG. 17 comprises a banding pattern table 49, an AND circuit A1, a flip-flop circuit FFa, an AND circuit A2, an AND circuit A3 and a flip-flop circuit FFb. The banding pattern table 49 outputs a banding data signal which is read when a table read signal is input from the CPU 40. The AND circuit A1 performs an AND operation on an output of the address decoder 45 and a strobe signal and a select signal output from the CPU 40. The flip-flop circuit FFa receives a clock signal output from the CPU 40 and an output of the AND circuit A1. The AND circuit A2 performs an AND operation on an output of the flip-flop circuit FFa and a write signal output from the CPU 40. An output of the AND circuit A2 is input to the flip-flop circuit FFb. Additionally, an output of the banding pattern table 49 is input to the flip-flop circuit FFb. The AND circuit A3 performs an AND operation on a select signal and a strobe signal output from the head driving unit 47. The flip-flop circuit FFb outputs contents held therein in accordance with an output of the AND circuit A3.

The head driving unit 47 is provided with an AND circuit A4 and a buffer B. The AND circuit A4 performs an AND operation on the output of the flip-flop circuit FFb and image data output from the image memory 44. The buffer B temporarily stores an output of the AND circuit A4.

Figure 18:
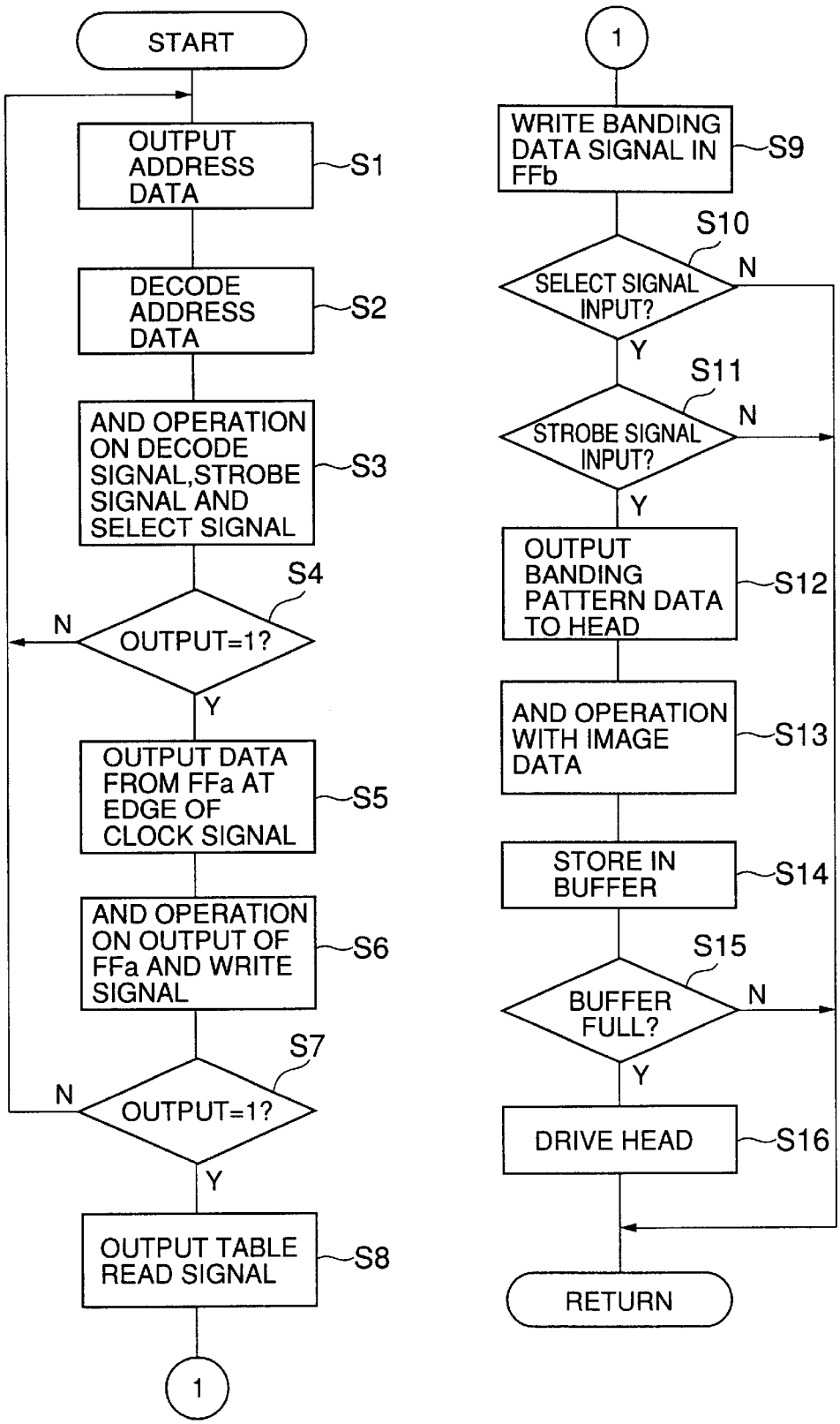
FIG. 18 is a flowchart of an operation performed by the banding pattern storing unit.

FIG. 18 is a flowchart of an operation performed by the banding pattern storing unit 46 shown in FIG. 17. When the operation shown in FIG. 18 is started, the CPU 40 outputs address data to the address decoder 45 in step S1. Then, in step S2, the address decoder 45 decodes the address data and outputs a decode signal to the AND circuit A1 of the banding pattern storing unit 46. The AND circuit A1 performs, in step S3, an AND operation on the decode signal and the strobe signal and the select signal output from the CPU 40.

It is determined, in step S4, whether or not an output of the AND circuit A1 is equal to "1". If the output of the AND circuit A1 is equal to "0", the routine returns to step S1 and an output of the flip-flop circuit FFa does not changed. On the other hand, if the output of the AND circuit A1 is equal to "1", this signal is input to the flip-flop circuit FFa, and the routine proceeds to step S5. In step S5, an output signal is output from the flip-flop circuit FFa at an edge (a rising edge or a falling edge) of the clock signal supplied by the CPU 40. The output signal of the flip-flop circuit FFa is input to the AND circuit A2.

Then, in step S6, the AND circuit A2 performs an AND operation on the output signal output from the flip-flop circuit FFa and write signal supplied by the CPU 40. It is then determined, in step S7, whether or not an output of the AND circuit A2 is equal to "1". If the output of the AND circuit A2 is equal to "0", the routine returns to step S1. On the other hand, if the output of the AND circuit A2 is equal to "1", the routine proceeds to S8. In step S8, the CPU 40 outputs the table read signal to the banding pattern table 49, and the banding pattern signal is output to the flip-flop circuit FFb. Since the signal equal to "1" is input to the flip-flop circuit FFb, the banding data signal output from the banding pattern table 49 is written in the flip-flop circuit FFb in step S9.

According to the above-mentioned process, data of the banding pattern corresponding to a single bit (single dot) is produced and held in the flip-flop circuit FFb. In the similar manner, the data of the banding pattern is produced on an individual bit basis and stored in each of other flip-flop circuits (not shown in the figure). After the banding pattern data is stored in each of the flip-flop circuits FFb, it is determined, in step S10, whether or not the select signal is output from the head driving unit 47 (hereinafter, the head driving units 47*y*, 47*m*, 47*c* and 47*k* may be referred to as head driving unit 47 as a whole). If the select signal is not output, the routine is ended. If the select signal is output from the head driving unit 47, the routine proceeds to step S11. It is then determined, in step S11, whether or not the strobe signal is output from the head driving unit 47. If the strobe signal is not output, the routine is ended. If the strobe signal is output from the head driving unit 47, the routine proceeds to step S12. In step S12, the banding pattern data stored in the flip-flop circuit FFb is output to the head driving unit 47 since both the select signal and the strobe signal are supplied to the banding pattern storing unit 46 and an output of the AND circuit A3 is equal to "1".

The AND circuit A4 of the head driving unit 47 performs, in step S13, an AND operation on the image data received from the image memory 44 and the banding pattern data received from the banding pattern storing unit 46. In step S15, a result of the AND operation is stored in the buffer B. It is then determined, in step S15, whether or not the buffer B is full. If the buffer B is not full, the routine returns to step S10. If the buffer is full, routine proceeds to step S16. In step S16, the head drive unit 47 controls the head 6 so as to record an image on a recording paper in accordance with the image data received from the image memory 44.

As mentioned above, the inkjet recording apparatus according to the present embodiment can easily produce and output the banding pattern by being provided with means for producing a print pattern which is used when the overlapping area is complemented and also provided with a flip-flop circuit for storing the produced print pattern.

Figure 19:
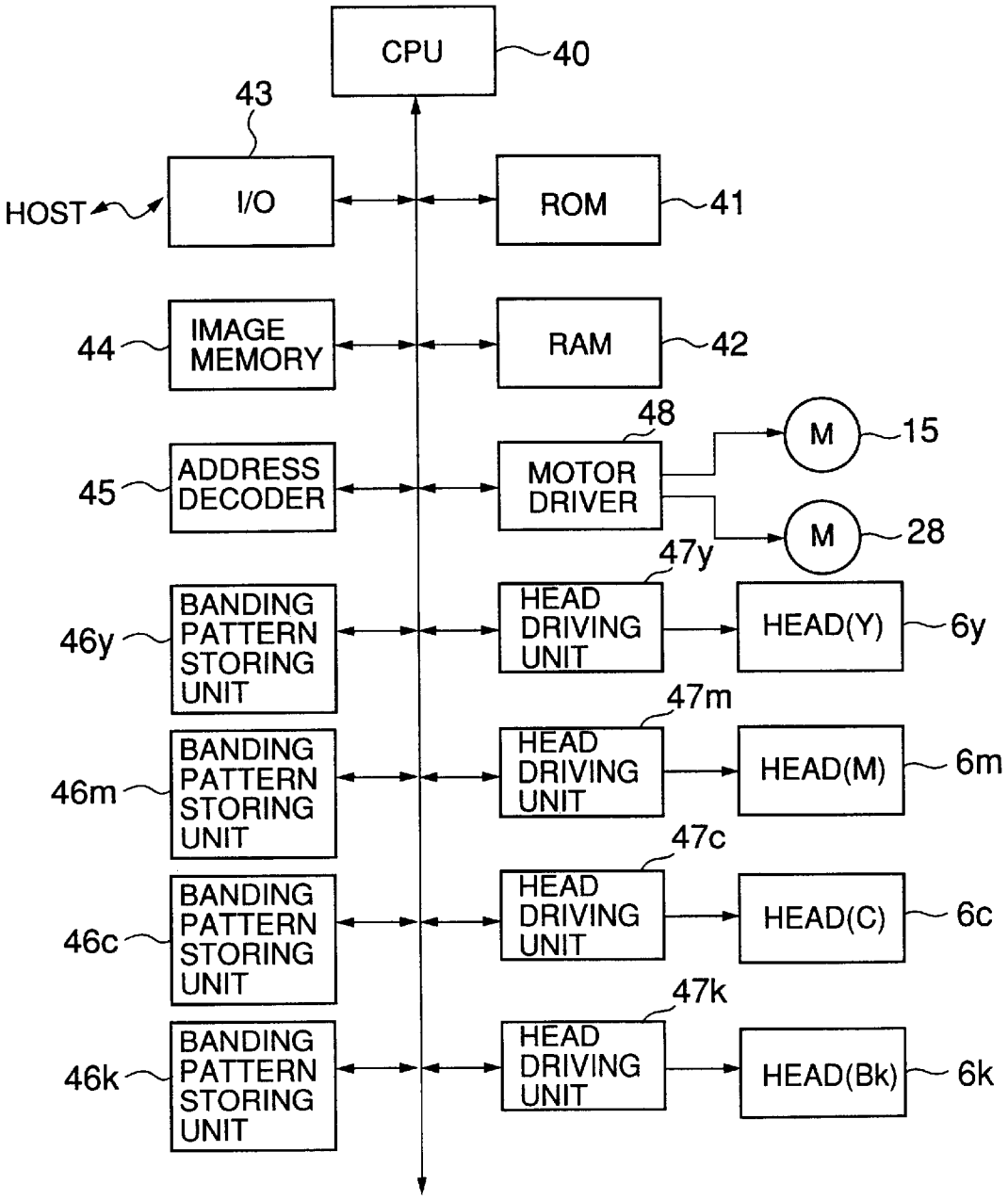
FIG. 19 is a block diagram of an inkjet recording apparatus according to a second embodiment of the present invention.

A description will now be given, with reference to FIG. 19, of a second embodiment of the present invention. FIG. 19 is a block diagram of an inkjet recording apparatus according to the second embodiment of the present invention. In FIG. 19, parts that are the same as the parts shown in FIG. 5 are given the same reference numerals, and descriptions thereof will be omitted.

The inkjet recording apparatus according to the second embodiment of the present invention has the same structure as that of the inkjet recording apparatus according to the first embodiment of the present invention except that a plurality of banding pattern storing units 46*y*, 46*m*, 46*c* and 46*k* are provided instead of the single banding pattern storing unit 46. In the inkjet recording apparatus according to the second embodiment of the present invention, the decode signal output from the address decoder 45 and the strobe signal and the select signal output from the CPU 40 are supplied to each of the banding pattern storing units 46*y*, 46*m*, 46*c* and 46*k*. The head driving units 47*y*, 47*m*, 47*c* and 47*k* outputs the select signal and the strobe signal to the respective banding pattern storing units 46*y*, 46*m*, 46*c* and 46*k* so as to read the banding pattern data stored in the banding pattern storing units 46*y*, 46*m*, 46*c* and 46*k*.

As mentioned above, the inkjet recording apparatus according to the present embodiment can easily produce and output the banding pattern by being provided with means for producing a print pattern for each color which print pattern is used when the overlapping area is complemented and also provided with a flip-flop circuit for storing the produced print pattern. Since the banding pattern is produced for each color, the band-like unevenness in a recorded color image can be reduced.

Figure 20:
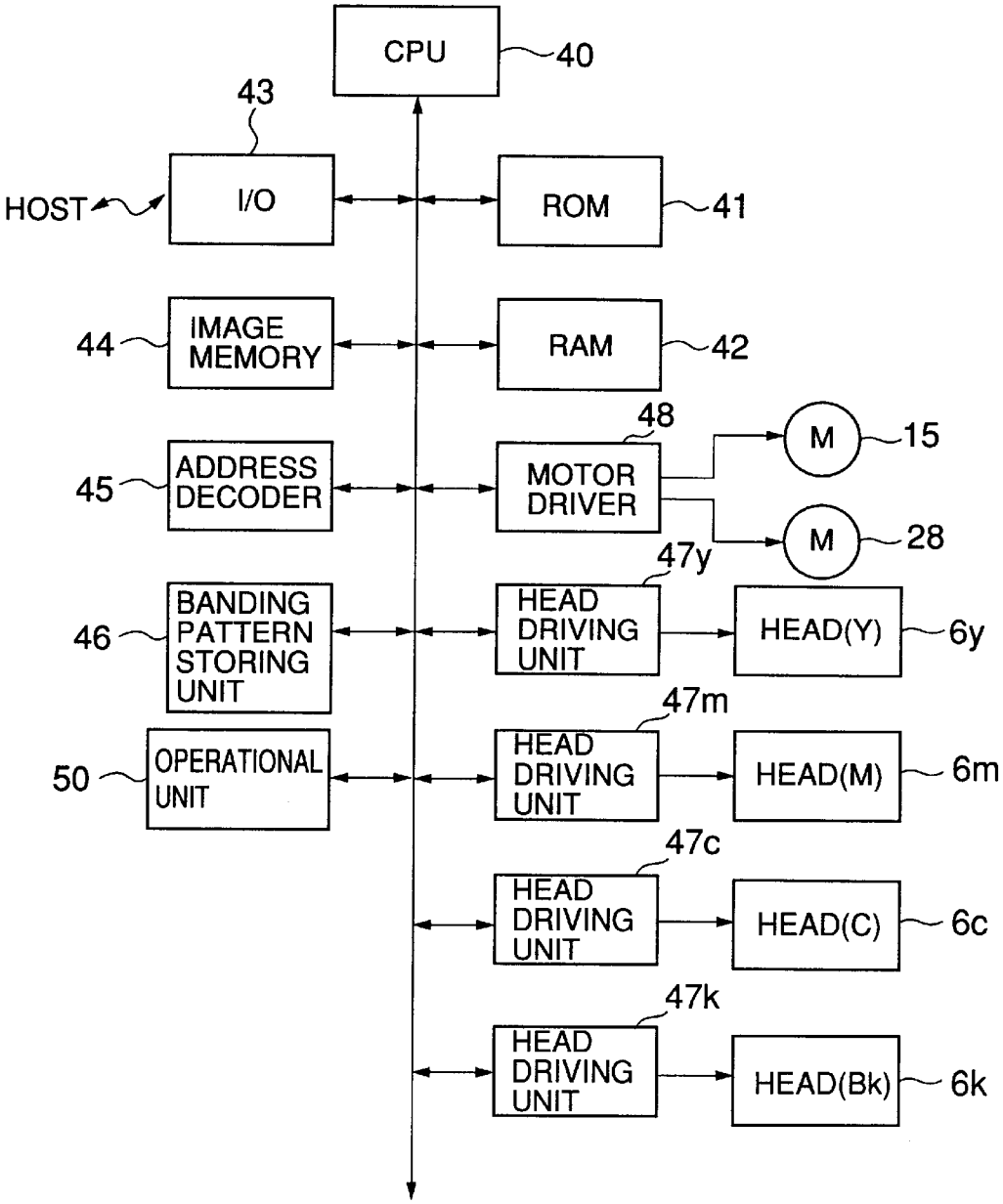
FIG. 20 is a block diagram of an inkjet recording apparatus according to a third embodiment of the present invention.

A description will now be given, with reference to FIG. 20, of a third embodiment of the present invention. FIG. 20 is a block diagram of an inkjet recording apparatus according to the third embodiment of the present invention. In FIG. 20, parts that are the same as the parts shown in FIG. 5 are given the same reference numerals, and descriptions thereof will be omitted.

The inkjet recording apparatus according to the third embodiment of the present invention has the same structure as that of the inkjet recording apparatus according to the first embodiment of the present invention except for an operational unit 50 being added so as to input information regarding a recording paper to be used. The operational unit 50 may be a switch, a key pad or a menu selecting system. An operator inputs information regarding a type of a recording paper to be used through the operational unit 50. The input information is stored in the RAM 42, and read when a printing operation is performed so as to change the number of dots included in the overlapping area in accordance with the type of the recording paper.

Figure 21:
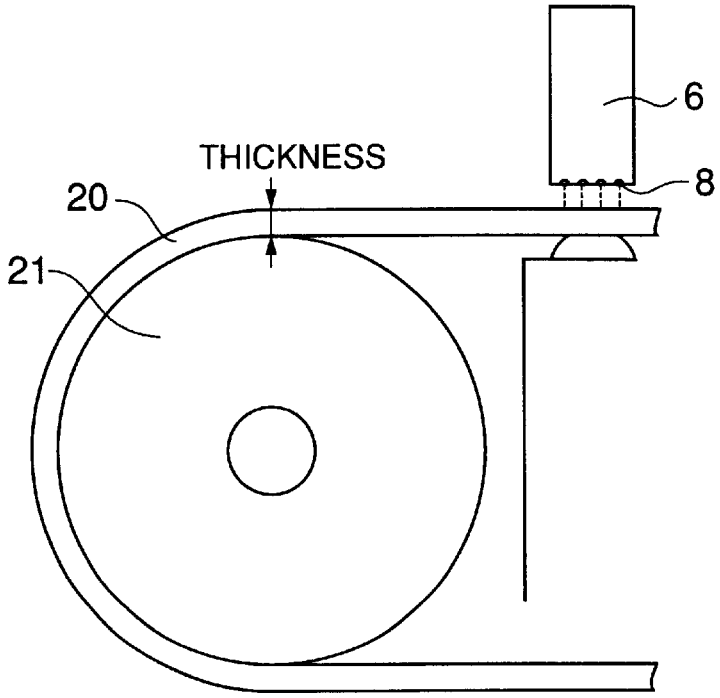
FIG. 21 is an illustration for explaining variation in an amount of shift of a recording paper in a sub-scanning direction due to variation in a thickness of the recording paper.

More specifically, when an image is printed on the recording paper 20 by using the recording head 6 while the recording paper 20 is conveyed by the convey roller 21 as shown in FIG.21, a travel distance of a surface of the recording paper 20 is varied due to variation in a thickness of the recording paper 20. Especially, when a thick paper or an OHP film is used, the travel distance in the sub-scanning direction is increased as compared to that of a regular paper since an increase in the thickness of the recording paper corresponds to an increase in the diameter of the convey roller 21.

Accordingly, in the present embodiment, the number of dots in the overlapping area is changed in accordance with a thickness of the recording paper to be used. For example, when a special paper having a thickness of less than 0.5 mm or a regular paper is used, the size of the banding pattern table is set to "3×64". When a thick paper having a thickness greater than 0.5 mm or an OHP film is used, the size of the banding pattern table is set to "4×80". This reduces generation of a white band or a black band in the recorded image, resulting in a high-quality image having less unevenness in the density of the recorded image that is ranked at the level 4.

In the present embodiment, a plurality of banding pattern tables may be provided so that an appropriate banding table is selectable in accordance with a type of a recording paper to be used. Alternatively, a rewritable memory may be provided in the inkjet recording apparatus for storing the banding pattern table data so that the banding pattern table data to be used can be transferred to the inkjet recording apparatus from a printer driver provided in a host computer.

Additionally, banding pattern table data corresponding to a plurality of banding pattern tables may be stored in a processor readable medium as a part of a printer driver so that the host computer can transfer a whole or a selected part of the banding pattern table data to the inkjet recording apparatus. The banding pattern table data stored in the processor readable medium may be data corresponding to a single kind.

Figure 22:
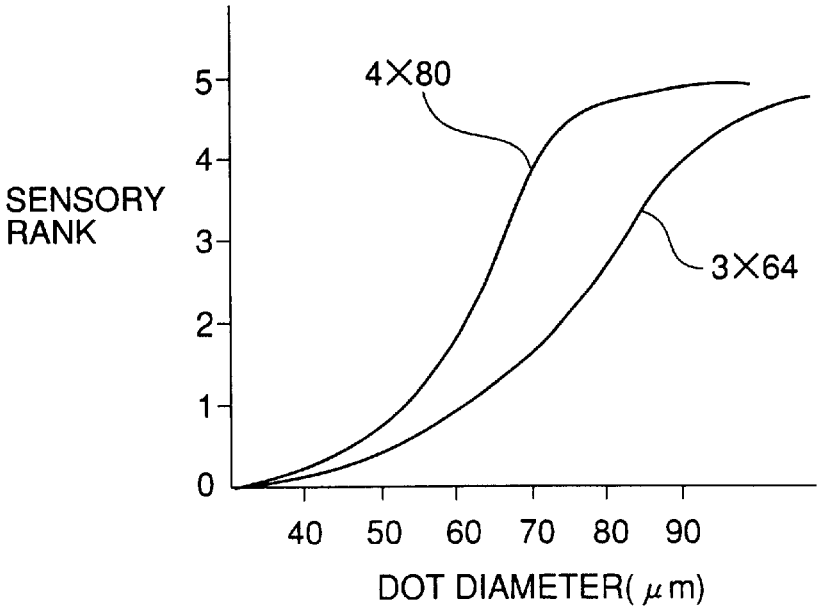
FIG. 22 is a graph showing a relationship between a dot diameter (horizontal axis) and sensory rank (vertical axis) when a banding pattern table is set to "3×64 and "4×80"

A description will now be given, with reference to FIG. 22, of a fourth embodiment of the present invention. FIG. 22 is a graph showing a relationship between a dot diameter (horizontal axis) and sensory rank (vertical axis) when the size of the banding pattern table is set to "3×64" and "4×80". Generally, a white band is hardly generated when a size of each dot is large. According to the graph shown in FIG. 22, in order to obtain the level 4 in the sensory rank, the "4×80" banding pattern table is needed when a dot diameter of 70 μm is used. On the other hand, when the dot diameter of 90 μm is used, the "3×64" banding pattern table is needed.

Accordingly, in the present embodiment, the size of the banding pattern table is changed according to the dot diameter. Thereby, band-like unevenness (banding) in the density of a recorded image which unevenness is generated in relation to an interlace printing method can be reduced. In this case, the banding pattern table to be used can be changed by providing a plurality of banding pattern tables in the inkjet recording apparatus, or transferring the banding pattern table from the host computer.

A description will now be given, with reference to FIGS. 23 to 26 of a fifth embodiment of the present invention. In an inkjet recording method according to the fifth embodiment of the present invention, the banding pattern table is changed in accordance with a type of the printing method.

Figure 23:
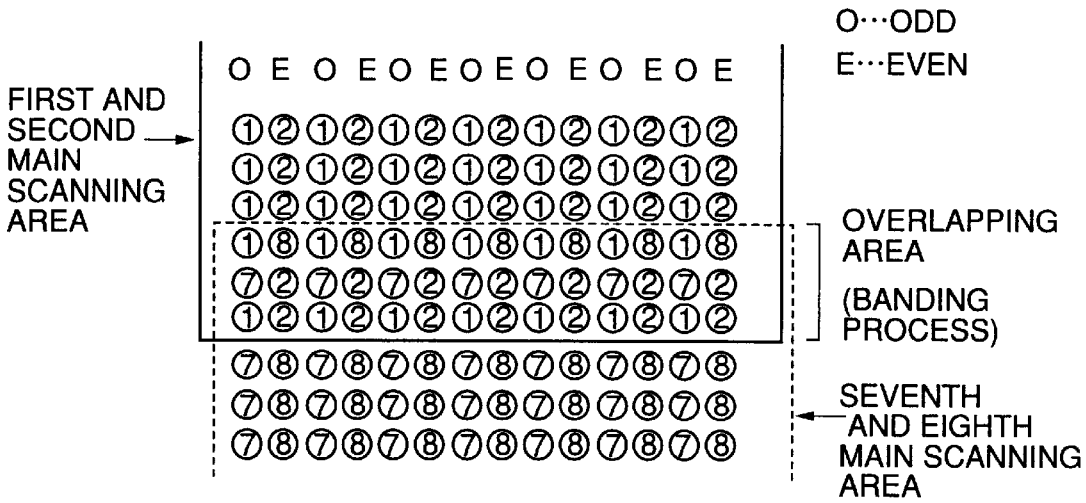
FIG. 23 is an illustration for explaining a multi-path method in which a series of dots arranged in a single line are recorded by a plurality of main scanning operations.

FIG. 23 is an illustration for explaining a multi-path method in which a series of dots arranged in a single line are recorded by a plurality of main scanning operations so that the dots corresponding to odd numbers are recorded by one of the two main scanning operations and the dots corresponding to even numbers are recorded by the other one of the two main scanning operations. In the example shown in FIG. 23, a single line is recorded by the two main scanning operations of the recording head. This method is referred to as a 2-path method. When a single line is recorded by a single main scanning operation of the recording head, this method is referred to as a 1-path method. In the 2-path method, the first main scanning area is recorded by two main scanning operations. That is, the first main scanning area is recorded by the first and second main scanning operations. Similarly, the fourth main scanning area is recorded by the seventh and eighth main scanning operations. Accordingly, the overlapping area is recorded by the first, second, seventh and eighth main scanning operations as shown in FIG. 23.

Figure 24A:
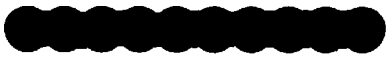
FIG. 24A is an illustration of a dot image recorded by a 1-path method.
Figure 24B:
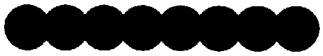
FIG. 24B is an illustration of a dot image recorded by a 2-path method.

The difference between a dot image recorded by the 1-path method and a dot image recorded by the 2-path method can be appreciated by referring to FIGS. 24A and 24B. FIG. 24A is an illustration of the dot image recorded by the 1-path method, and FIG. 24B is an illustration of the dot image recorded by the 2-path method. In the 1-path method, adjacent dots are consecutively recorded. That is, the adjacent dots are recorded almost at the same time. Accordingly, an ink drop of a dot merges with an ink drop of the immediately preceding dot. However, in the 2-path method, an ink drop of a dot is projected onto the recording paper after ink drops forming the adjacent dots are projected onto the recording paper and are completely absorbed by the recording paper. Accordingly, each dots is formed with a relatively clear contour of the dot as shown in FIG. 24B.

Figure 25:
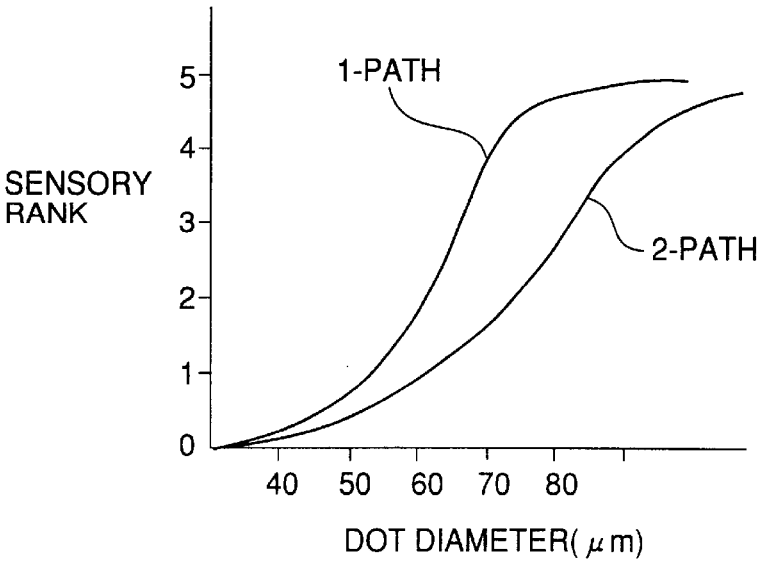
FIG. 25 is a graph representing a relationship between a dot diameter and sensory rank when a recording is performed by using the 1-path method and the 2-path method.

FIG. 25 shows a graph representing a relationship between the dot diameter and the sensory rank when a recording is performed by using the 1-path method and the 2-path method. In the example shown in FIG. 25, the "4×80" banding pattern table is used for both the 1-path method and the 2-path method.

According to the 1-path method, the sensory rank 4 (good) is achieved when the recording is performed with the dot diameter of 70 μm. However, according to the 2-path method, when the same dot diameter (70 μm) is used, the sensory rank 2 (little bad) is achieved. This means that if the same size banding pattern table is used, image quality obtained by the 2-path method is lower than image quality obtained by the 1-path method.

Figure 26:
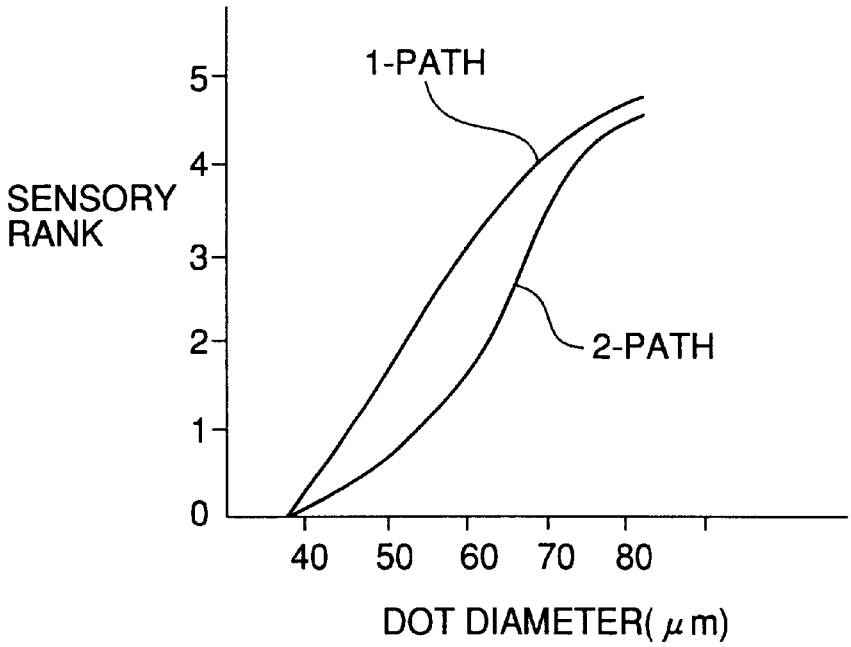
FIG. 26 is a graph representing a relationship between the dot diameter and the sensory rank when a recording is performed by using the 1-path method and the 2-path method.

FIG. 26 shows a graph representing a relationship between the dot diameter and the sensory rank when a recording is performed by using the 1-path method and the 2-path method. In the example shown in FIG. 26, a "5×128" banding pattern table is used for both the 1-path method and the 2-path method. As shown in FIG. 26, the sensory rank 4 (good) can be obtained by using the 2-path method even when the dot diameter is 70 μm.

Accordingly, in the present embodiment, the size of the banding pattern table is changed in accordance with a printing method to be used. Thus, band-like unevenness (banding) in the density of a recorded image which unevenness is generated in relation to an interlace printing method can be reduced.

Figure 27:
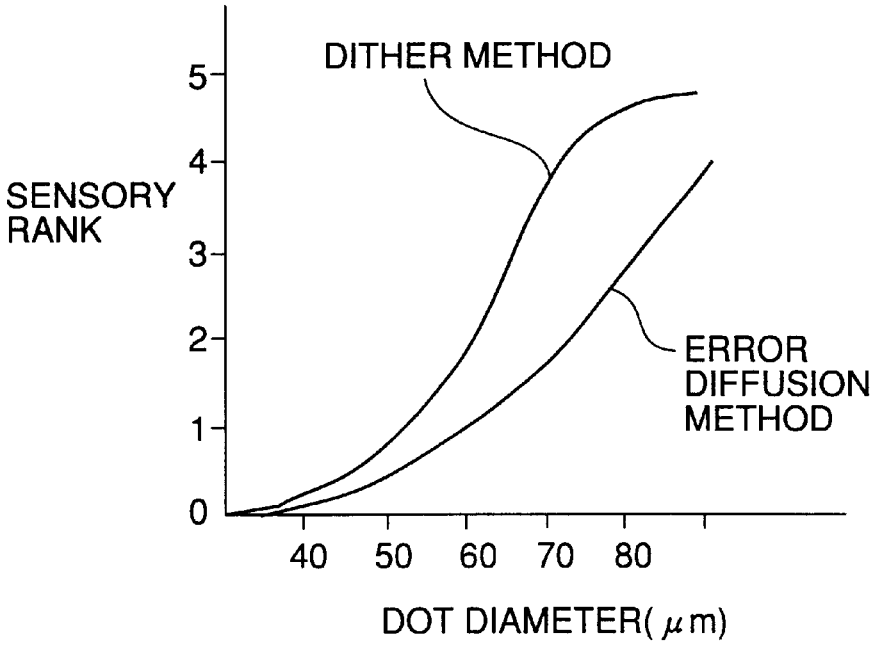
FIG. 27 is a graph representing a relationship between the dot diameter and the sensory rank when a recording is performed by using a Dither method and an error diffusion method.

A description will now be given, with reference to FIGS. 27 and 28, of a sixth embodiment of the present invention. In an inkjet recording apparatus according to the sixth embodiment of the present invention, the banding pattern table is changed in accordance with a type of a halftone processing method.

As for the halftone processing method, there are Dither method and an error diffusion method. The error diffusion method generates unevenness (banding) stronger than the Dither method. FIG. 27 shows a graph representing a relationship between the dot diameter and the sensory rank when a recording is performed by using the Dither method and the error diffusion method. In the example shown in FIG. 27, the "4×80" banding pattern table is used for both the Dither method and the error diffusion method.

According to the Dither method, the sensory rank 4 (good) is achieved when the recording is performed with the dot diameter of 70 μm. However, according to the error diffusion method, when the same dot diameter (70 μm) is used, the sensory rank 2 (little bad) is achieved. This means that if a banding pattern table of the same size is used, an image quality obtained by the error diffusion method is lower than an image quality obtained by the Dither method.

Figure 28:
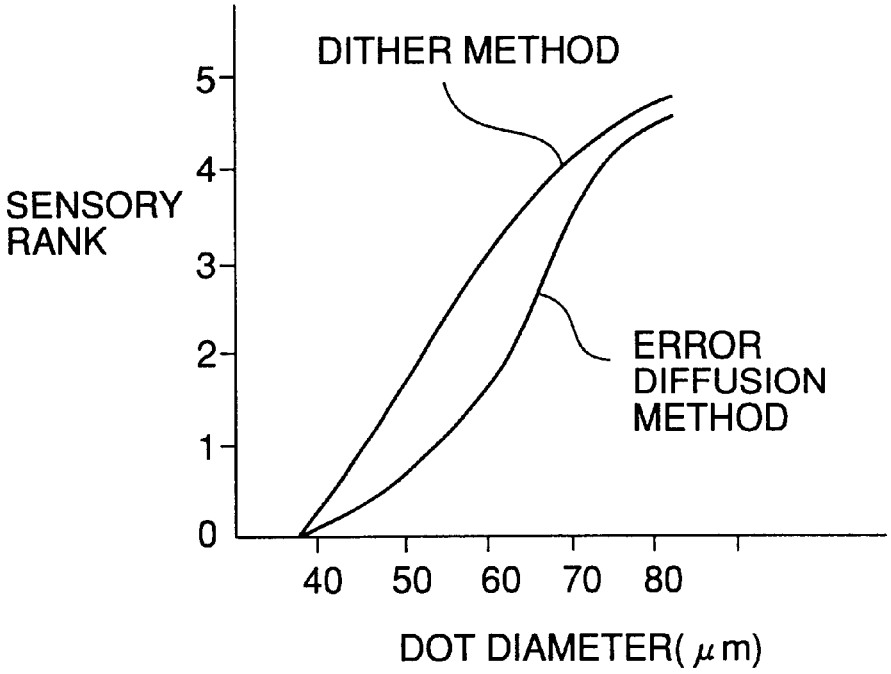
FIG. 28 is a graph representing a relationship between the dot diameter and the sensory rank when a recording is performed by using the Dither method and the error diffusion method.

FIG. 28 shows a graph representing a relationship between the dot diameter and the sensory rank when a recording is performed by using the Dither method and the error diffusion method. In the example shown in FIG. 28, a "6×256" banding pattern table is used for both the Dither method and the error diffusion method. As shown in FIG. 28, the sensory rank 4 (good) can be obtained by using the error diffusion method even when the dot diameter is 70 μm.

Accordingly, in the present embodiment, the size of the banding pattern table is changed in accordance with a halftone processing method to be used. Thus, band-like unevenness (banding) in the density of a recorded image which unevenness is generated in relation to an interlace printing method can be reduced.

A description will now be given of a seventh embodiment of the present invention. An inkjet recording apparatus according to the seventh embodiment of the present invention has the same hardware structure as that of the inkjet recording apparatus according to the first embodiment of the present invention, and descriptions thereof will be omitted. The inkjet recording apparatus according to the seventh embodiment of the present invention uses an interlace printing method different from the interlace printing method used in the inkjet recording apparatus according to the first embodiment of the present invention.

In the inkjet recording apparatus according to the first to sixth embodiments of the present invention, all dots arranged in a single line are recorded by the same nozzle. This method is referred to as a single-nozzle line method. However, in the inkjet recording apparatus according to the present embodiment, dots in a single line are recorded by a plurality of nozzles. This method is referred to as a multi-nozzle line method.

Figure 29A:
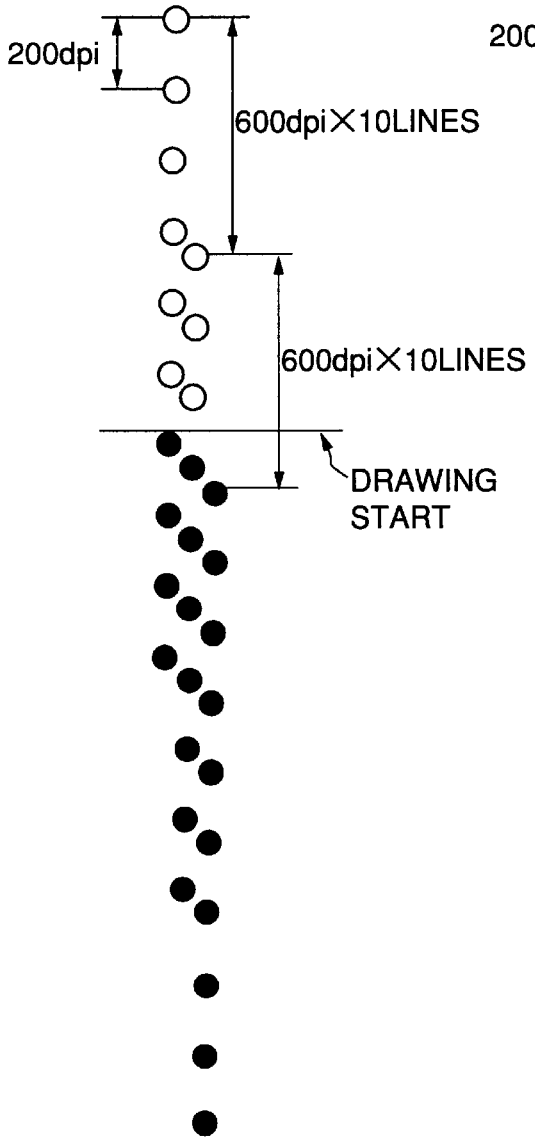
FIG. 29A is an illustration for explaining an example of an interlace printing method using a single-nozzle line method.
Figure 29B:
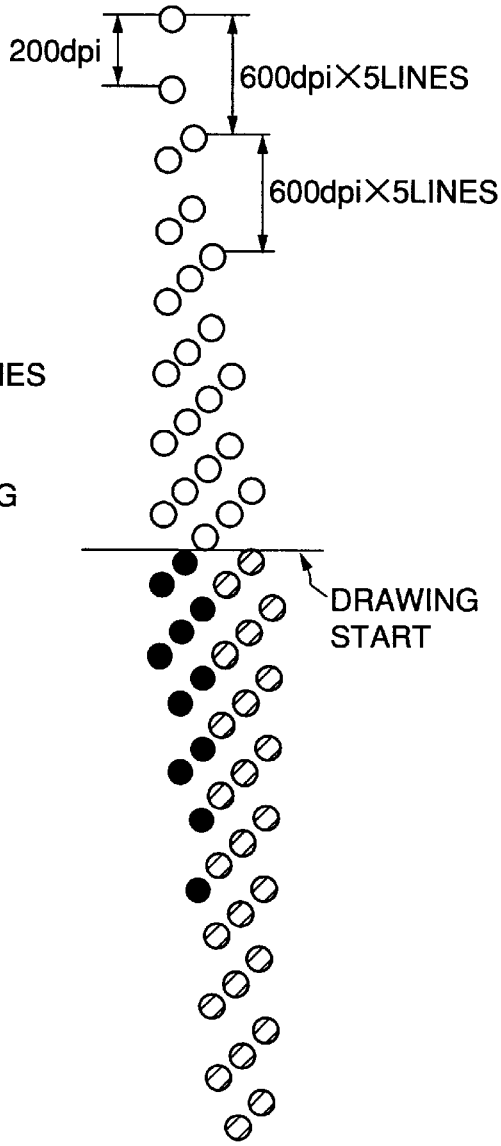
FIG. 29B is an illustration for explaining an example of an interlace printing method using a multi-nozzle line method.

FIG. 29A is an illustration for explaining an example of the interlace printing method using the single-nozzle line method. FIG. 29B is an illustration for explaining an example of the interlace printing method using the multi-nozzle line method.

In FIG. 29A, a pitch D of nozzles corresponds to 200 dpi (dot/inch). That is, the pitch D is set to 1/200 inches. In this case, the number N of nozzles can be represented by the following equation.

$$N=m1\times(k\times m2+a)+Nov$$

where m1 is a number of main scanning operations to be performed for recording a single line in the main scanning direction (this corresponds to a number of nozzles that record a single line in the main scanning direction); a is an integer equal to or greater than 1 ($a\geqq 1$); m2 is an integer equal to or greater than 1 ($m2\geqq 1$); Nov is a number of nozzles used for recording an overlapping area.

An amount of shift S1 in the sub-scanning direction can be represented as follows, where k is an integer determined so that a desired dot pitch is represented by D/k.

$$S1=(m2+a/k)\times D$$

In order to achieve a 600 dpi image by the interlace printing method, k is set to 3 since the 600 dpi is three times the 200 dpi. Since the number of nozzles is 10 in the example shown in FIG. 29A, m1 is set to 1 and m2 is set to 3. It should be noted that Nov is set to 0 for the sake of simplification. In this case, the amount of shift S1 is calculated as:

$$S1=(3+1/3)\times D$$

On the other hand, according to the multi-nozzle line method, in order to achieve a higher dpi image, an amount S2 of shift in the sub-scanning direction is reduced to S1/m1. This means that a time required for recording an image by using the multi-nozzle line method is m1 times longer than that when the single-nozzle line method is used. However, the image quality achieved by the multi-nozzle line method is higher than the image quality achieved by the single-nozzle line method. This is because, for example, deflection in an orientation of each nozzle is diffused by a plurality of nozzles.

In the example shown in FIG. 29B, m1 is set to 2. That is, two nozzles are used for recording a single line. K is set to 3 so as to achieve a 600 dpi image. If the number of nozzles is 10 and the Nov is set to 0, m2 should be set to 1, and a should be set to 2. In FIG. 29A, black circles indicate dots corresponding to odd numbers in the main scanning direction, and hatched circles indicate dots corresponding to even numbers.

Figure 30:
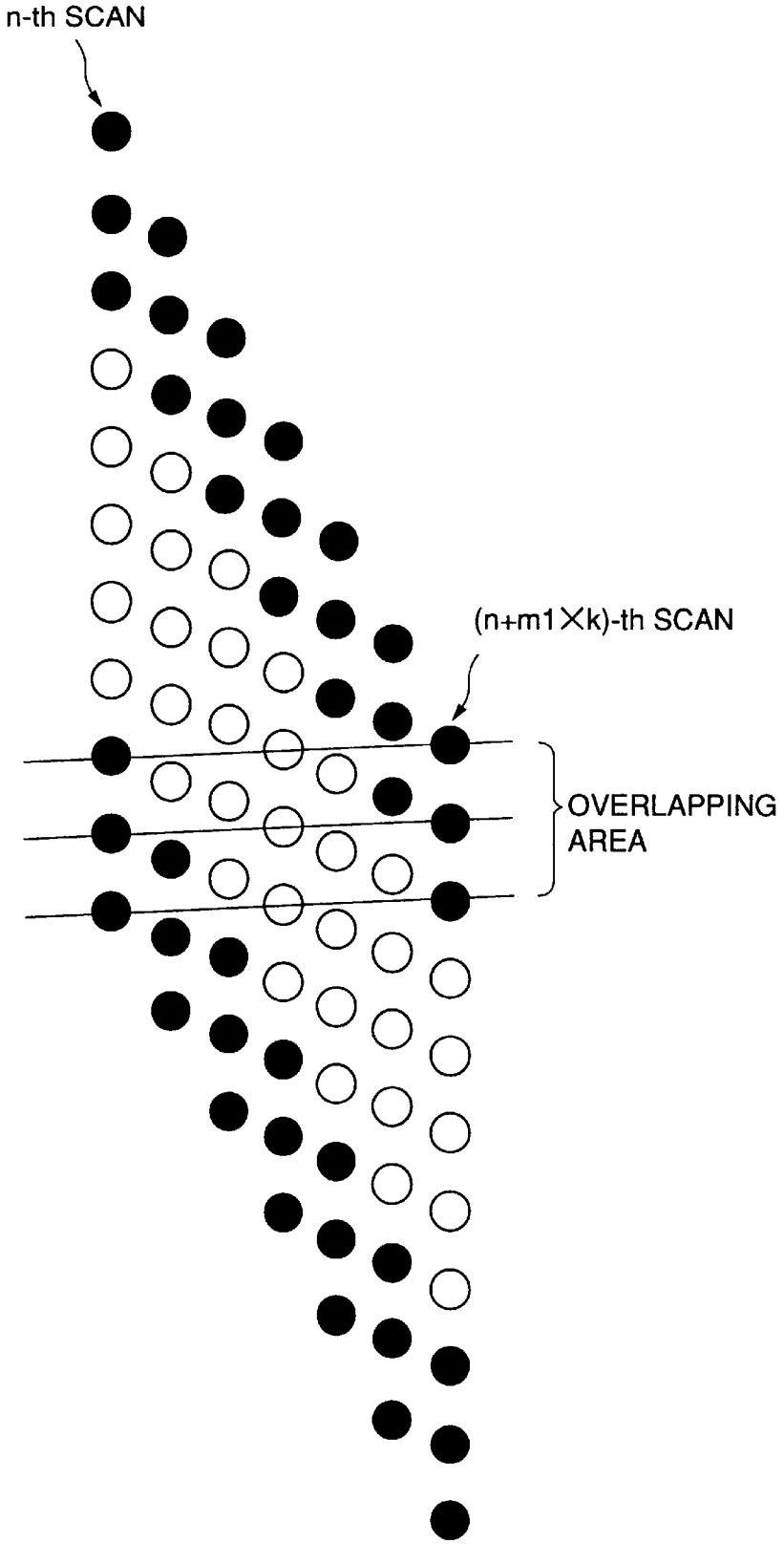
FIG. 30 is an illustration for explaining a dot image recorded by the multi-nozzle line method with an overlapping area.

FIG. 30 is an illustration for explaining a dot image recorded by the multi-nozzle line method with an overlapping area such as that described in the previous embodiments. In FIG. 30, the overlapping area includes three rows of dots. That is, the overlapping area is recorded by the upper three nozzles and the lower three nozzles. In FIG. 30, the dots corresponding to the nozzles for recording the overlapping area are indicated by black circles. However, the overlapping area is recorded by the nozzles other than the upper three nozzles and the lower three nozzles as indicated by white circles. Accordingly, in order to apply the banding process described in the above-mentioned first embodiment to an image recorded by the multi-nozzle line method, the banding process should be applied to the nth main scanning operation and the (n+m1×k)th main scanning operation.

According to the present embodiment, an effect of the multi-nozzle line method is achieved together with the effect of the banding process of the above-mentioned first to sixth embodiments.

The present invention is not limited to the specifically disclosed embodiments, and variations and modifications may be made without departing from the scope of the present invention.

The present application is based on Japanese priority application No.10-137835 filed on May 20, 1998, the entire contents of which are hereby incorporated by reference.

What is claimed is:

1. An inkjet recording apparatus for recording a dot image on a recording medium by using an interlace recording method, said inkjet recording apparatus comprising:

a recording head having a plurality of nozzles arranged at a uniform interval D in a sub-scanning direction;

a moving mechanism for moving the recording medium in the sub-scanning direction; and a control unit which controls a scanning operation so that k times main scanning operations are performed within the interval D, where k is an integer equal to or greater than 2, wherein a part of an area recorded by the nth main scanning operation is overlapped with a part of an area recorded by the (n+k)th main scanning operation, where n is an integer equal to or greater than 1;

a part of dots included in said overlapping area is recorded by the nth main scanning operation so that the rest of the dots included in said overlapping area are complementarily recorded by the (n+k)th main scanning operation;

a memory storing a banding pattern table used for the complementary recording, said banding pattern table being defined by a matrix "R×C", where R is a number of rows of the dotes included in said overlapping area and C is a number of dots arranged in the main scanning direction; and a determining unit determining whether each of the dots included in said overlapping are is to be recorded by the nth main scanning operation or the (n+k)th main scanning operation, wherein a size of the banding pattern table is greater than "2×3" or "3×2".

2. The inkjet recording apparatus as claimed in claim 1, wherein the size of the banding pattern table is changed in accordance with the recording medium on which the dot image is recorded.

3. The inkjet recording apparatus as claimed in claim 1, wherein the size of the banding pattern table is changed in accordance with a diameter of each of the dots.

4. The inkjet recording apparatus as claimed in claim 1, wherein the size of the banding pattern table is changed in accordance with a number of main scanning operations for recording a single line.

5. The inkjet recording apparatus as claimed in claim 1, wherein the size of the banding pattern table is changed in accordance with a halftone processing method to be used.

6. The inkjet recording apparatus as claimed in claim 1, wherein said memory stores a plurality of banding pattern tables having different sizes so as to select one of the banding pattern table to be used from among the banding pattern tables.

7. An inkjet recording apparatus for recording a dot image on a recording medium by using an interlace recording method, said inkjet recording apparatus comprising:

a recording head having a plurality of nozzles arranged at a uniform interval D in a sub-scanning direction;

a moving mechanism for moving the recording medium in the sub-scanning direction; and a control unit which controls a scanning operation so that k times main scanning operations are performed within the interval D, where k is an integer equal to or greater than 2, wherein a part of an area recorded by the nth main scanning operation is overlapped with a part of an area recorded by the (n+m1×k)th main scanning operation so as to form an overlapping area, where n is an integer equal to or greater than 1 and m1 is a number of nozzles used for recording a single line;

a part of dots included in said overlapping area is recorded by the nth main scanning operation so that the rest of the dots included in said overlapping area are complementarily recorded by the (n+m1×k)th main scanning operation;

a number of nozzles N is represented by the following equation:

$$N=m1\times(k\times m2+a)+Nov$$

where Nov is a number of rows included in said overlapping area, m2 is an integer equal to or greater than 1 and a is an integer equal to or greater than 1, and an amount of shift S of said recording head in the sub-scanning direction is represented by the following equation:

$$S=(m2+a/k)\times D.$$

8. The inkjet recording apparatus as claimed in claim 7, wherein said control unit includes:

a memory storing a banding pattern table used for the complementary recording, said banding pattern table being defined by a matrix "R×C", where R is a number of rows of the dots included in said overlapping area and C is a number of dots arranged in the main scanning direction; and a determining unit determining whether each of the dots included in said overlapping area is to be recorded by the nth main scanning operation or the (n+k)th main scanning operation, wherein a size of the banding pattern table is greater than "2×3" or "3×2".

9. The inkjet recording apparatus as claimed in claim 8, wherein the size of the banding pattern table is changed in accordance with the recording medium on which the dot image is recorded.

10. The inkjet recording apparatus as claimed in claim 8, wherein the size of the banding pattern table is changed in accordance with a diameter of each of the dots.

11. The inkjet recording apparatus as claimed in claim 8, wherein the size of the banding pattern table is changed in accordance with a number of main scanning operations for recording a single line.

12. The inkjet recording apparatus as claimed in claim 8, wherein the size of the banding pattern table is changed in accordance with a halftone processing method to be used.

13. The inkjet recording apparatus as claimed in claim 8, wherein said memory stores a plurality of banding pattern tables having different sizes so as to select one of the banding pattern table to be used from among the banding pattern tables.

14. An inkjet recording method for recording a dot image on a recording medium by using an interlace recording method, an inkjet recording operation being performed by an inkjet recording apparatus comprising:

a recording head having a plurality of nozzles arranged at a uniform interval D in a sub-scanning direction;

a moving mechanism for moving the recording medium in the sub-scanning direction; and a control unit which controls a scanning operation so that k times main scanning operations are performed within the interval D, where k is an integer equal to or greater than 2, said inkjet recording method comprising the steps of:

recording a first area by the nth main scanning operation, where n is an integer equal to or greater than 1;

recording a second area by the (n+k)th main scanning operation so that a part of said second area is overlapped with a part of the first recording area so as to form an overlapping area, wherein a part of dots included in said overlapping area is recorded by the nth main scanning operation so that the rest of the dots included in said overlapping area are complementarily recorded by the (n+k)th main scanning operation;

storing a banding pattern table used for the complementary recording in a memory, said banding pattern table being defined by a matrix "R×C", where R is a number of rows of the dots included in said overlapping area and C is a number of dots arranged in the main scanning direction; and determining whether each of the dots included in said overlapping area is to be recorded by the nth main scanning operation or the (n+k)th main scanning operation, wherein a size of the banding pattern table is greater than "2×3" or "3×2".

15. The inkjet recording method as claimed in claim 14, further comprising the step of:

transferring a banding pattern table from a host computer to said inkjet recording apparatus so that the banding pattern table is stored in said memory.

16. An inkjet recording method for recording a dot image on a recording medium by using an interlace recording method, an inkjet recording operation being performed by an inkjet recording apparatus comprising:

a recording head having a plurality of nozzles arranged at a uniform interval D in a sub-scanning direction;

a moving mechanism for moving the recording medium in the sub-scanning direction; and a control unit which controls a scanning operation so that k times main scanning operations are performed within the interval D, where k is an integer equal to or greater than 2, said inkjet recording method comprising the steps of:

recording a first area by the nth main scanning operation, where n is an integer equal to or greater than 1; and recording a second area by the (n+m1×k)th main scanning operation so that a part of said second area is overlapped with a part of first recording area so as to form an overlapping area and m1 is a number of nozzles used for recording a single line, wherein a part of dots included in said overlapping area is recorded by the nth main scanning operation so that the rest of the dots included in said overlapping area are complementarily recorded by the (n+m1×k)th main scanning operation; and a number of nozzles N is represented by the following equation:

$$N=1\times(k\times m2+a)+Nov$$

where Nov is a number of rows included in said overlapping area, m2 is an integer equal to or greater than 1 and a is an integer equal to or greater than 1, and an amount of shift S of said recording head in the sub-scanning direction is represented by the following equation:

$$S=(m2+a/k)\times D.$$

17. The inkjet recording method as claimed in claim 16, further comprising the steps of:

storing a banding pattern table used for the complementary recording in a memory, said banding pattern table being defined by a matrix "R×C", where R is a number of rows of the dots included in said overlapping area and C is a number of dots arranged in the main scanning direction; and determining whether each of the dots included in said overlapping area is to be recorded by the nth main scanning operation or the (n+k)th main scanning operation, wherein a size of the banding pattern table is greater than "2×3" or "3×2".

18. The inkjet recording method as claimed in claim 16, further comprising the step of:

transferring a banding pattern table from a host computer to said inkjet recording apparatus so that the banding pattern table is stored in said memory.

19. A processor readable medium storing a printer driver including program code for causing a computer to perform an inkjet recording method for recording a dot image on a recording medium by using an interlace recording method, an inkjet recording operation being performed by an inkjet recording apparatus comprising:

a recording head having a plurality of nozzles arranged at a uniform interval D in a sub-scanning direction;

a moving mechanism for moving the recording medium in the sub-scanning direction; and a control unit which controls a scanning operation so that k times main scanning operations are performed within the interval D, where k is an integer equal to or greater than 2, said processor readable medium comprising:

first program code means for recording a first area by the nth main scanning operation, where n is an integer equal to or greater than 1;

second program code means for recording a second area by the (n+k)th main scanning operation so that a part of said second area is overlapped with a part of the first recording area so as to form an overlapping area, wherein a part of dots included in said overlapping area is recorded by the nth main scanning operation so that the rest of the dots included in said overlapping area are complementarily recorded by the (n+k)th main scanning operation;

a third program code means for storing a banding pattern table used for the complementary recording in a memory, said banding pattern table being defined by a matrix "R×C", where R is a number of rows of the dots included in said overlapping area and C is a number of dots arranged in the main scanning direction; and fourth program code means for determining whether each of the dots included in said overlapping area is to be recorded by the nth main scanning operation or the (n+k)th main scanning operation, wherein a size of the banding pattern table is greater than "2×3" or "3×2".

20. The processor recording medium as claimed in claim 19, further comprising:

fifth program code means for transferring a banding pattern table from a host computer to said inkjet recording apparatus so that the banding pattern table is stored in said memory.

21. A processor readable medium storing a printer driver including program code for causing a computer to perform an inkjet recording method for recording a dot image on a recording medium by using an interlace recording method, an inkjet recording operation being performed by an inkjet recording apparatus comprising:

a recording head having a plurality of nozzles arranged at a uniform interval D in a sub-scanning direction;

a moving mechanism for moving the recording medium in the sub-scanning direction; and a control unit which controls a scanning operation so that k times main scanning operations are performed within the interval D, where k is an integer equal to or greater than 2, said processor readable medium comprising:

first program code means for recording a first area by the nth main scanning operation, where n is an integer equal to or greater than 1; and second program code means for recording a second area by the (n+m1×k)th main scanning operation so that a part of said second area is overlapped with a part of first recording area so as to form an overlapping area and m1 is a number of nozzles used for recording a single line, wherein a part of dots included in said overlapping area is recorded by the nth main scanning operation so that the rest of the dots included in said overlapping area are complementarily recorded by the (n+m1×k)th main scanning operation; and a number of nozzles N is represented by the following equation:

$$N=m1\times(k\times m2+a)+Nov$$

where Nov is a number of rows included in said overlapping area, m2 is an integer equal to or greater than 1 and a is an integer equal to or greater than 1, and an amount of shift S of said recording head in the sub-scanning direction is represented by the following equation:

$$S=(m2+a/k)\times D.$$

22. The processor readable medium as claimed in claim 21, further comprising:

third program code means for storing a banding pattern table used for the complementary recording in a memory, said banding pattern table being defined by a matrix "R×C", where R is a number of rows of the dots included in said overlapping area and C is a number of dots arranged in the main scanning direction; and fourth program code means for determining whether each of the dots included in said overlapping area is to be recorded by the nth main scanning operation or the (n+k)th main scanning operation, wherein a size of the banding pattern table is greater than "2×3" or "3×2".

23. The processor readable medium as claimed in claim 22, further comprising the step of:

fifth program code means for transferring a banding pattern table from a host computer to said inkjet recording apparatus so that the banding pattern table is stored in said memory.

* * * * *